US011072192B2

(12) United States Patent
Kitamura et al.

(10) Patent No.: US 11,072,192 B2
(45) Date of Patent: Jul. 27, 2021

(54) PRINTING UNIT AND THERMAL PRINTER

(71) Applicant: Seiko Instruments Inc., Chiba (JP)

(72) Inventors: Masashi Kitamura, Chiba (JP); Tomohiro Murata, Chiba (JP); Akio Naito, Chiba (JP); Kouji Kawaguchi, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 16/710,759

(22) Filed: Dec. 11, 2019

(65) Prior Publication Data

US 2020/0207126 A1 Jul. 2, 2020

(30) Foreign Application Priority Data

Dec. 28, 2018 (JP) ..... JP2018-247009
Mar. 12, 2019 (JP) ..... JP2019-044789

(51) Int. Cl.
*B41J 11/70* (2006.01)
*B41J 2/32* (2006.01)

(52) U.S. Cl.
CPC . *B41J 11/70* (2013.01); *B41J 2/32* (2013.01)

(58) Field of Classification Search
CPC ... B41J 2/32; B41J 2/335; B41J 3/4075; B41J 11/66; B41J 11/70
See application file for complete search history.

(56) References Cited

U.S. PATENT DOCUMENTS

2011/0026999 A1* 2/2011 Kohira ..... B41J 29/38 400/621
2014/0056633 A1 2/2014 Tsuchiya et al.

FOREIGN PATENT DOCUMENTS

EP 2135716 A2 12/2009
EP 2135716 A3 12/2010
(Continued)

OTHER PUBLICATIONS

Extended European Search Report in Europe Application No. 19219806.7, dated Jun. 5, 2020, 5 pages.

*Primary Examiner* — Scott A Richmond
(74) *Attorney, Agent, or Firm* — Brinks Gilson & Lione

(57) ABSTRACT

A printing unit includes a head unit; a platen unit separately combined with the head unit; a fixed blade provided to the platen unit; a movable blade, which is provided to the head unit and is relatively movable with respect to the fixed blade; a drive mechanism, which includes a drive rack coupled to the movable blade, and moves the movable blade between a standby position being separated from the fixed blade and a cutting position at which the movable blade rides on the fixed blade; an operation lever being movable between a lock position and a releasing position; and a return mechanism configured to move the movable blade from the cutting position toward the standby position side through intermediation of the drive rack in association with the operation lever. The return mechanism includes a lever returning mechanism, under the state in which movable blade is stopped at the cutting position, transmits motive power generated along with an operation of the operation lever from the lock position toward the releasing position to the drive mechanism to move the movable blade toward the
(Continued)

standby position and returns the operated operation lever from the releasing position side to the lock position.

14 Claims, 23 Drawing Sheets

(56) References Cited

FOREIGN PATENT DOCUMENTS

| | | | |
|---|---|---|---|
| EP | 2749429 | A1 | 7/2014 |
| JP | 2014-040077 | A | 3/2014 |

* cited by examiner

PRINTING UNIT AND THERMAL PRINTER

RELATED APPLICATIONS

This application claims priority to Japanese Patent Application No. 2018-247009 filed on Dec. 28, 2018, and 2019-044789 filed on Mar. 12, 2019, the entire contents of which are incorporated herein by reference.

BACKGROUND OF THE INVENTION

1. Field of the Invention

The present invention relates to a printing unit and a thermal printer.

2. Description of the Related Art

A thermal printer, for example, includes a printing unit. The printing unit is configured to cut paper between a movable blade and a fixed blade by moving the movable blade from a standby position to a cutting position. When the movable blade is moved to the cutting position to cut paper, a paper jam sometimes occurs between the movable blade and the fixed blade, and the movable blade may stop at a position at which the movable blade rides on the fixed blade.

There has been known a configuration in which, for example, an operation lever is operated to open a gap between the movable blade and the fixed blade in order to eliminate such a paper jam. The load of the paper jam is removed by forming a gap between the movable blade and the fixed blade. Through removal of the load of the paper jam, the movable blade can be returned to a home position (hereinafter referred to as "standby position") with an elastic restoring force of a spring.

However, in the related-art configuration in which a gap is formed between the fixed blade and the movable blade, when a paper jam larger than the gap occurs, it is difficult to completely remove the load of the paper jam. Therefore, even when a gap is formed between the fixed blade and the movable blade by one operation of the operation lever, there is a risk in that the movable blade may not be returned. In this case, it is required to eliminate the paper jam by repeatedly operating the operation lever. Therefore, a capability in eliminating the paper jam is low.

Further, when the paper jam cannot be eliminated, a state in which the movable blade remains stopping at a position of riding on the fixed blade is maintained. Thus, a cover of a printer having the fixed blade mounted thereon cannot be opened, with the result that neither the fixed blade nor the movable blade can be exposed to an outside. Thus, when a paper jam larger than a gap occurs, it is difficult to eliminate the paper jam, and hence there remains room for improvement in view of the elimination of the paper jam.

In view of the circumstances described above, a printing unit and a thermal printer, which are capable of easily eliminating a paper jam, have been desired in the technical field relating to the printing unit and the thermal printer.

SUMMARY OF THE INVENTION

According to one embodiment of the present invention, there is provided a printing unit, including a head unit including a thermal head configured to perform printing on a recording sheet; a platen unit, which includes a platen roller configured to convey the recording sheet, and is separately combined with the head unit; a fixed blade provided to any one of the head unit and the platen unit; a movable blade, which is provided to another one of the head unit and the platen unit, and is relatively movable with respect to the fixed blade; a drive mechanism, which includes a drive rack coupled to the movable blade, and is configured to move the movable blade between a standby position being separated from the fixed blade and a cutting position at which the movable blade rides on the fixed blade; an operation lever being movable between a lock position at which the platen unit is locked to the head unit and a releasing position at which the platen unit is unlocked from the head unit; and a return mechanism configured to move the movable blade from the cutting position toward the standby position side through intermediation of the drive rack in association with the operation lever under a state in which the movable blade is stopped at the cutting position, wherein the return mechanism includes a lever returning mechanism configured to, under the state in which movable blade is stopped at the cutting position, transmit motive power generated along with an operation of the operation lever from the lock position toward the releasing position to the drive mechanism to move the movable blade toward the standby position and to return the operated operation lever from the releasing position side to the lock position.

In the above-mentioned printing unit according to the one embodiment of the present invention, wherein the lever returning mechanism includes a clutch member, which is configured to rotate along with movement of the operation lever, and has a first engagement portion; a ratchet wheel, which is formed so as to surround the clutch member, and has a second engagement portion to be engaged with the first engagement portion when the clutch member is rotated in one direction, the ratchet wheel being capable of performing transmission of the motive power from and to the drive mechanism; a biasing member configured to bias the operation lever from the releasing position side toward the lock position, wherein, when the operation lever is operated from the lock position toward the releasing position side under the state in which the movable blade is stopped at the cutting position, the clutch member and the ratchet wheel are both rotated through engagement between the first engagement portion and the second engagement portion so as to transmit the motive power from the ratchet wheel to the drive mechanism, and wherein, when the operation lever is moved from the releasing position side toward the lock position by the biasing member under the state in which the movable blade is stopped at the cutting position, the first engagement portion and the second engagement portion are placed in a non-engaged state to allow the clutch member to idle with respect to the ratchet wheel.

In the above-mentioned thermal printer according to the one embodiment of the present invention, wherein the return mechanism includes a return rack formed on the drive rack; and a return pinion to be meshed with rack teeth of the return rack, and wherein the ratchet wheel has external teeth to be meshed with the return pinion.

In the above-mentioned printing unit according to the one embodiment of the present invention, wherein the return mechanism includes a sun gear, which is rotatably supported about a rotation axis of the operation lever, and is coupled to the clutch member in a state of being arranged coaxially with the rotation axis of the operation lever; a planetary gear, which is to be meshed with the sun gear, and is revolved along with movement of the operation lever; and an internal gear to be meshed with the planetary gear when the planetary gear is revolved, and wherein, when the operation lever is located at the lock position, the meshing of the planetary gear with the internal gear is released to permit the planetary gear to idle.

In the above-mentioned printing unit according to the one embodiment of the present invention, wherein the return mechanism includes a correction member configured to correct a posture of the planetary gear with respect to the internal gear so that the planetary gear is meshed with the internal gear in a predetermined meshing relationship when the planetary gear is revolved.

In the above-mentioned printing unit according to the one embodiment of the present invention, wherein the correction member is configured to correct the posture of the planetary gear to achieve such a meshing relationship that a tooth tip of a corresponding one of planetary tooth portions of the planetary gear and a tooth tip of a first tooth of internal tooth portions of the internal gear, with which the planetary gear is to be first meshed, are prevented from coming into contact with each other.

In the above-mentioned printing unit according to the one embodiment of the present invention, wherein the correction member comprises an elastic member, which is disposed so as to be closer to the lock position of the operation lever than the internal gear, and with which the planetary tooth portions are to be brought into sliding contact, and wherein the elastic member is elastically deformed when the planetary tooth portions are brought into sliding contact with the elastic member, and shifts a phase of the planetary gear along with elastic restoring deformation.

In the above-mentioned printing unit according to the one embodiment of the present invention, wherein the rack teeth are formed on a side opposite to a blade edge of the movable blade so that the rack teeth are meshed with the return pinion when the movable blade is located at the cutting position and the meshing with the return pinion is released when the movable blade is located at the standby state.

In the above-mentioned printing unit according to the one embodiment of the present invention, wherein, when the movable blade is stopped at the cutting position, an operation stroke amount of the operation lever from the lock position toward the releasing position is set so that the movable blade is returned from the cutting position to the standby position through multiple times of operations of the operation lever.

In the above-mentioned printing unit according to the one embodiment of the present invention, wherein the operation stroke amount is set so that the movable blade is returned from the cutting position to the standby position through repetition of the operation of the operation lever twice.

According to one embodiment of the present invention, there is provided a thermal printer, including the above-mentioned printing unit; a printer main body, which includes a recording-sheet receiving portion configured to receive the recording sheet, and to which one of the head unit and the platen unit, the one being provided with the movable blade, is mounted; and a printer cover, to which another one of the head unit and the platen unit, the another one being provided with the fixed blade, is mounted, and is pivotably coupled to the printer main body.

DETAILED DESCRIPTION OF THE PREFERRED EMBODIMENTS

Figure 1:
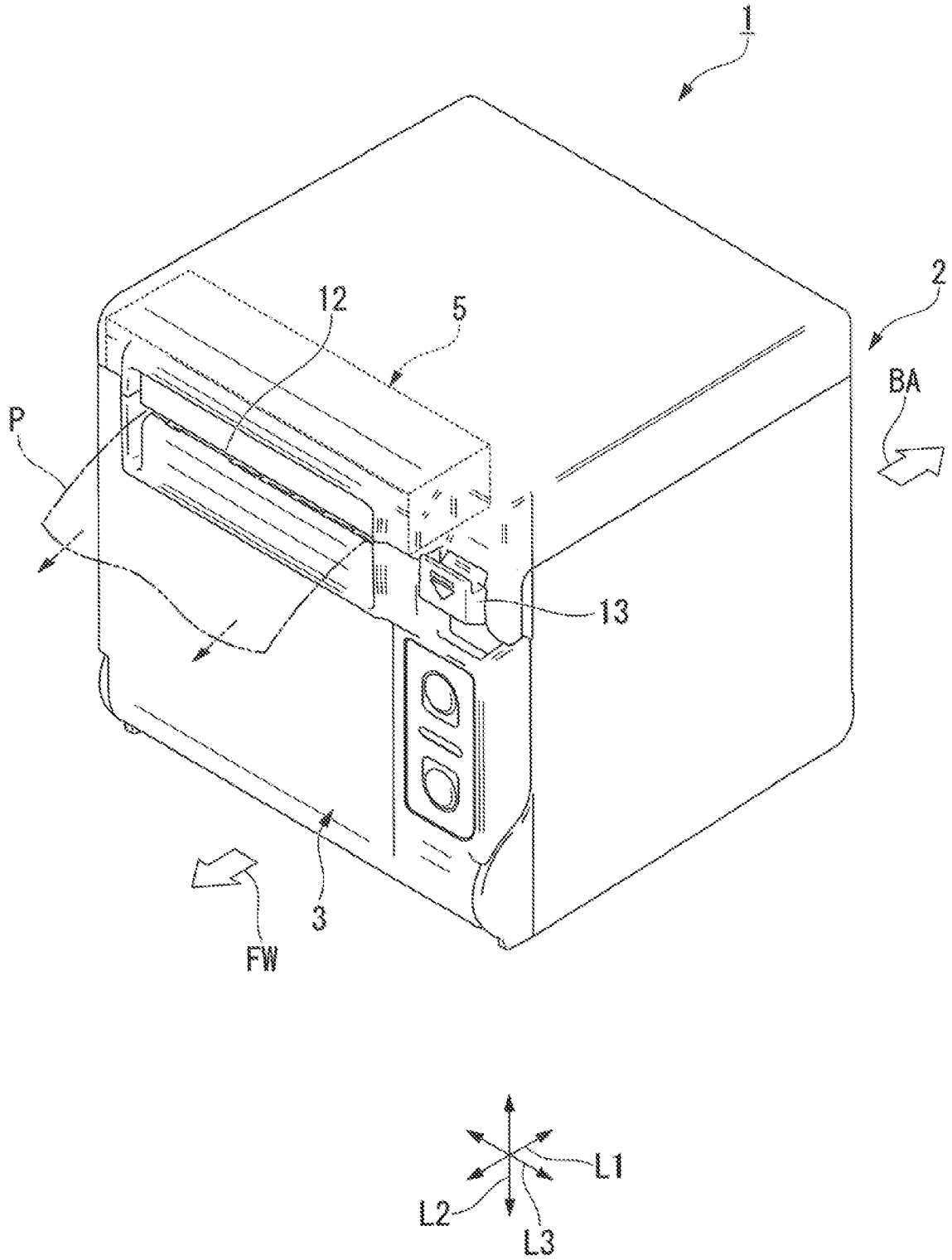
FIG. 1 is a perspective view of a thermal printer according to an embodiment of the present invention under a state in which a printer cover is closed.
Figure 2:
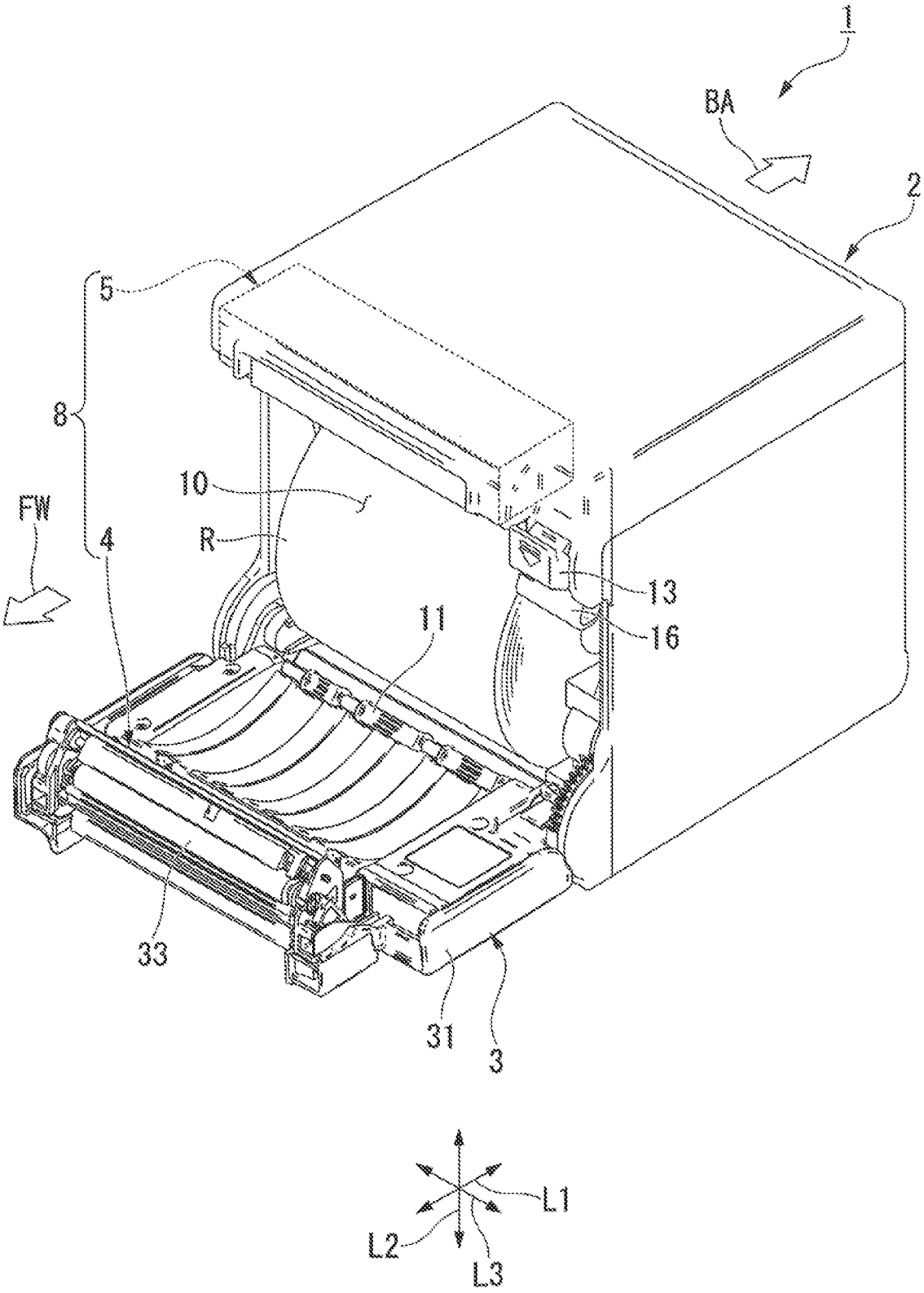
FIG. 2 is a perspective view of the thermal printer under a state in which the printer cover illustrated in FIG. 1 is open.

Now, embodiments of the present invention are described with reference to the accompanying drawings. As illustrated in FIG. 1 and FIG. 2, a thermal printer 1 is a printer (terminal) configured to perform printing on a recording sheet P (for example, heat-sensitive paper) pulled out from a roll sheet R so that the recording sheet P can be used as a ticket, a receipt, or the like. The thermal printer 1 includes a casing (printer main body according to the present invention) 2, a printer cover 3, a platen unit 4 provided on the printer cover 3 side, and a head unit 5 provided on the casing 2 side. The platen unit 4 and the head unit 5 form a printing unit 8.

In this embodiment, at the closed position of the printer cover 3 illustrated in FIG. 1, a lower left side (printer cover 3 side) of a drawing sheet is defined as a forward side (direction of the arrow FW), an upper right side (casing 2 side) thereof is defined as a backward side (direction of the arrow BA), an upper side thereof is defined as an upward side, and a lower side thereof is defined as a downward side. Further, the recording sheet P is delivered to the forward side FW. A direction orthogonal to a front-and-back direction L1 and an up-and-down direction L2 is defined as a right-and-left direction L3.

The casing 2 is made of a resin material, a metal material, or an appropriate combination thereof and is formed into a cube shape opened to the forward side FW. However, a shape of the casing 2 is not limited to the shape described above, and may be suitably changed. The casing 2 includes a frame body serving as a basic skeleton, and an exterior cover for covering the frame body. A recording-sheet receiving portion 10 configured to receive the roll sheet R is formed in the casing 2, and the recording-sheet receiving portion 10 is opened to the forward side FW by opening the printer cover 3.

The recording-sheet receiving portion 10 has a box shape that is formed of a part of the above-mentioned frame body and is opened to the forward side FW. The recording-sheet receiving portion 10 is configured to receive the roll sheet R on an inner side thereof under a state in which a width direction of the roll sheet R is matched with the right-and-left direction L3.

A first pivot shaft 11 extending along the right-and-left direction L3 is arranged in a lower portion of an opening edge of the casing 2. The printer cover 3 is coupled to the first pivot shaft 11 so as to be pivotable with respect to the casing 2. The printer cover 3 pivots within an angle range of about 90° between the closed position (position illustrated in FIG. 1) at which an opening portion of the casing 2 is closed and the open position (position illustrated in FIG. 2) at which the opening portion of the casing 2 is opened. With this, the opening portion of the casing 2 (that is, the recording-sheet receiving portion 10) is opened and closed by the printer cover 3. When the printer cover 3 is at the open position, the recording-sheet receiving portion 10 is opened, and for example, the roll sheet R can be loaded into the recording-sheet receiving portion 10 (so-called drop-in system).

The thermal printer 1 has a configuration in which a slight gap is formed between a distal end portion of the printer cover 3 and the casing 2 when the printer cover 3 is located at the closed position. The recording sheet P is pulled out from an inner portion of the casing 2 to the forward side FW through use of the gap. Thus, the slight gap serves as a delivery port 12 of the recording sheet P.

When the printer cover 3 is located at the closed position, the casing 2 and the printer cover 3 are locked with each other along with combination of the platen unit 4 and the head unit 5. Further, of corner portions positioned on an upper front side of the casing 2, the corner portion positioned on one side in the right-and-left direction L3 is provided with an operation lever 13 configured to release the combination (locking) between the platen unit 4 and the head unit 5 to perform an opening operation of the printer cover 3.

Figure 3:
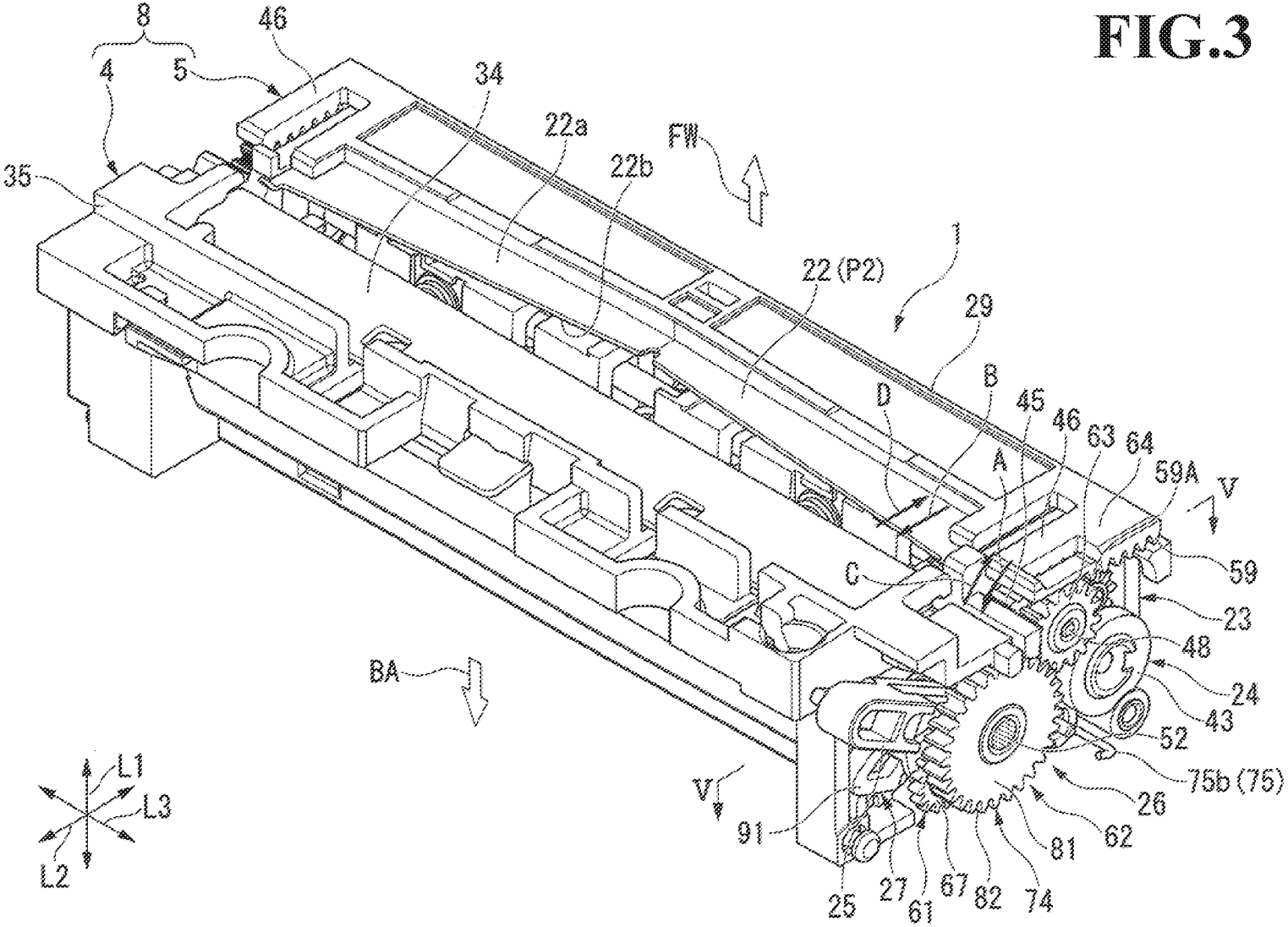
FIG. 3 is a perspective view of a printing unit illustrated in FIG. 2.

As illustrated in FIG. 2 and FIG. 3, the head unit 5 is a unit in which a thermal head (not shown) and a movable blade 22 are mainly incorporated, and is arranged on the upper front side inside the casing 2. The head unit 5 is fixed to an inner plate (not shown) extending downward from an upper surface of the casing 2 and is held on the forward side FW with respect to the recording-sheet receiving portion 10.

The head unit 5 mainly includes a head frame 23, the thermal head, the movable blade 22, a drive mechanism 24, an operation lever 25, a return mechanism 26, and an unlocking mechanism 27. The head frame 23 is formed of, for example, a frame made of metal. The thermal head includes a plurality of heating elements arrayed in a line shape along the right-and-left direction L3.

The platen unit 4 is mounted on an upper portion of an inner surface of the printer cover 3 at a position at which the platen unit 4 overlaps with a reinforcing member 31 in the front-and-back direction L1, and is separately combined with the head unit 5 along with an opening/closing operation of the printer cover 3. Specifically, the platen unit 4 includes a platen roller 33, a fixed blade 34, and a platen frame 35.

The platen roller 33 is a roller configured to convey the recording sheet P to an outside of the printer cover 3. The fixed blade 34 is provided in the printer cover 3 and is arranged on the forward side FW with respect to the platen roller 33. The platen frame 35 is a frame configured to support the platen roller 33 and the fixed blade 34. Thus, the fixed blade 34 is provided on the printer cover 3. Therefore, it is not required to provide, on the printer cover 3, the drive mechanism 24 configured to drive the movable blade 22. With this, the printer cover 3 can be reduced in weight, and the operability for opening and closing the printer cover 3 can be satisfactorily ensured.

When the printer cover 3 is located at the closed position, the thermal head is opposed to the platen roller 33 to allow passage of the recording sheet P between the thermal head and the platen roller 33. Further, a coil spring configured to bias the thermal head downwardly (to the platen roller 33 side) is interposed between the thermal head and the platen roller 33. With this, the thermal head can be reliably pressed against the recording sheet P sent out by the platen roller 33, and satisfactory printing can be performed by the printing unit 8.

Figure 4:
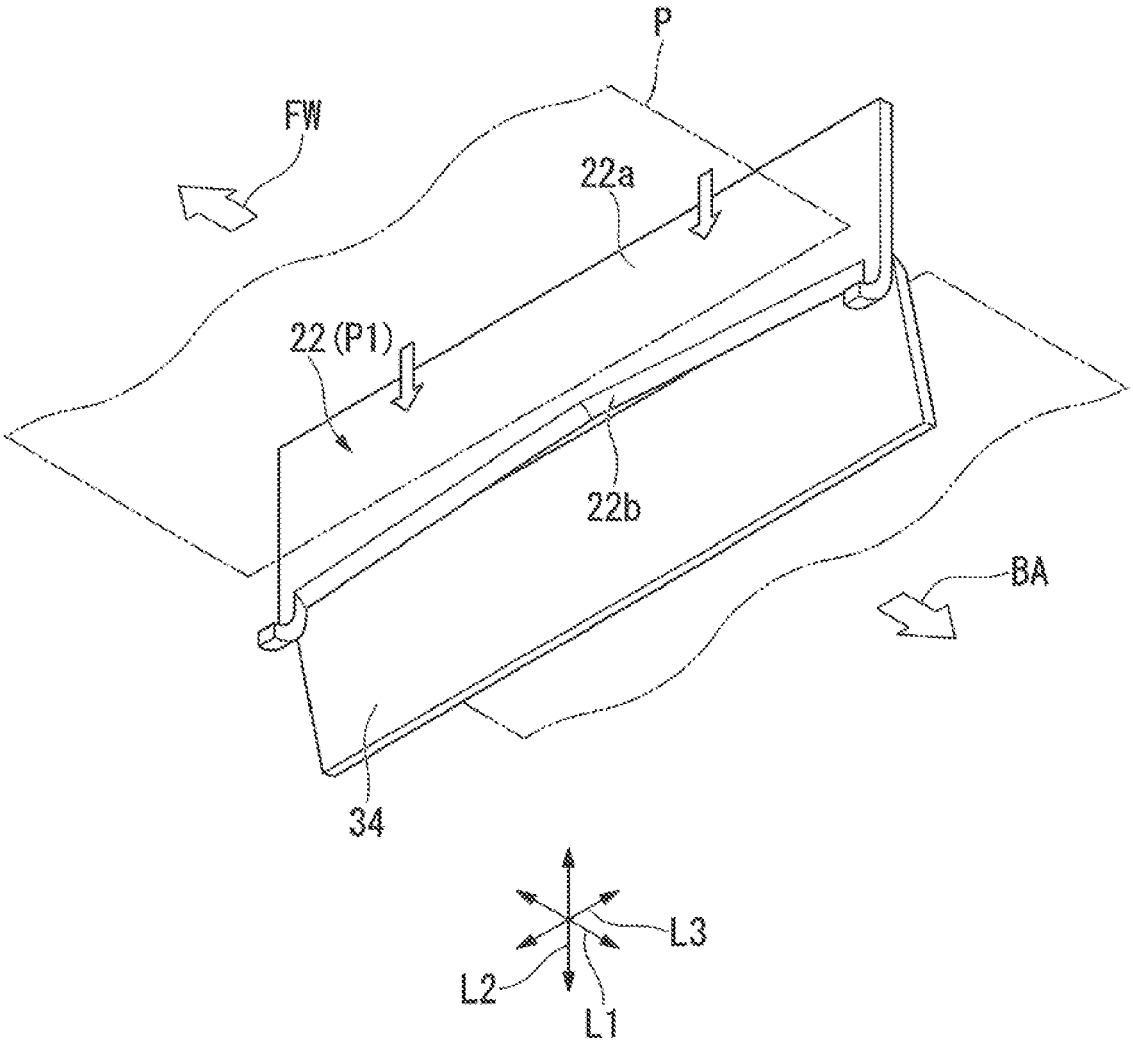
FIG. 4 is a perspective view for illustrating a state in which a recording sheet is cut between a fixed blade and a movable blade of the printing unit illustrated in FIG. 3.

As illustrated in FIG. 3 and FIG. 4, the movable blade 22 is provided on the casing 2 (see FIG. 2) through intermediation of the drive mechanism 24. FIG. 4 is a perspective view for illustrating a state in which the movable blade 22 is moved to cut the recording sheet P between the fixed blade 34 and the movable blade 22. The movable blade 22 is arranged so as to be opposed to the fixed blade 34 in the front-and-back direction L1 under a state in which the printer cover 3 is located at the closed position (see FIG. 1) of and in which the head unit 5 and the platen unit 4 are combined with each other. The movable blade 22 is a plate-like blade having a V shape formed so that a length from a root 22*a* to a blade edge 22*b* gradually becomes shorter from both ends to a center.

The movable blade 22 is mounted on drive racks 46 of the drive mechanism 24 through intermediation of a movable blade holder 29. The movable blade 22 is formed so as to be movable in the up-and-down direction L2 with respect to the head frame 23 due to the operation of the drive mechanism 24. With this, the movable blade 22 is supported so as to be movable with respect to the fixed blade 34 in the up-and-down direction L2.

Figure 5:
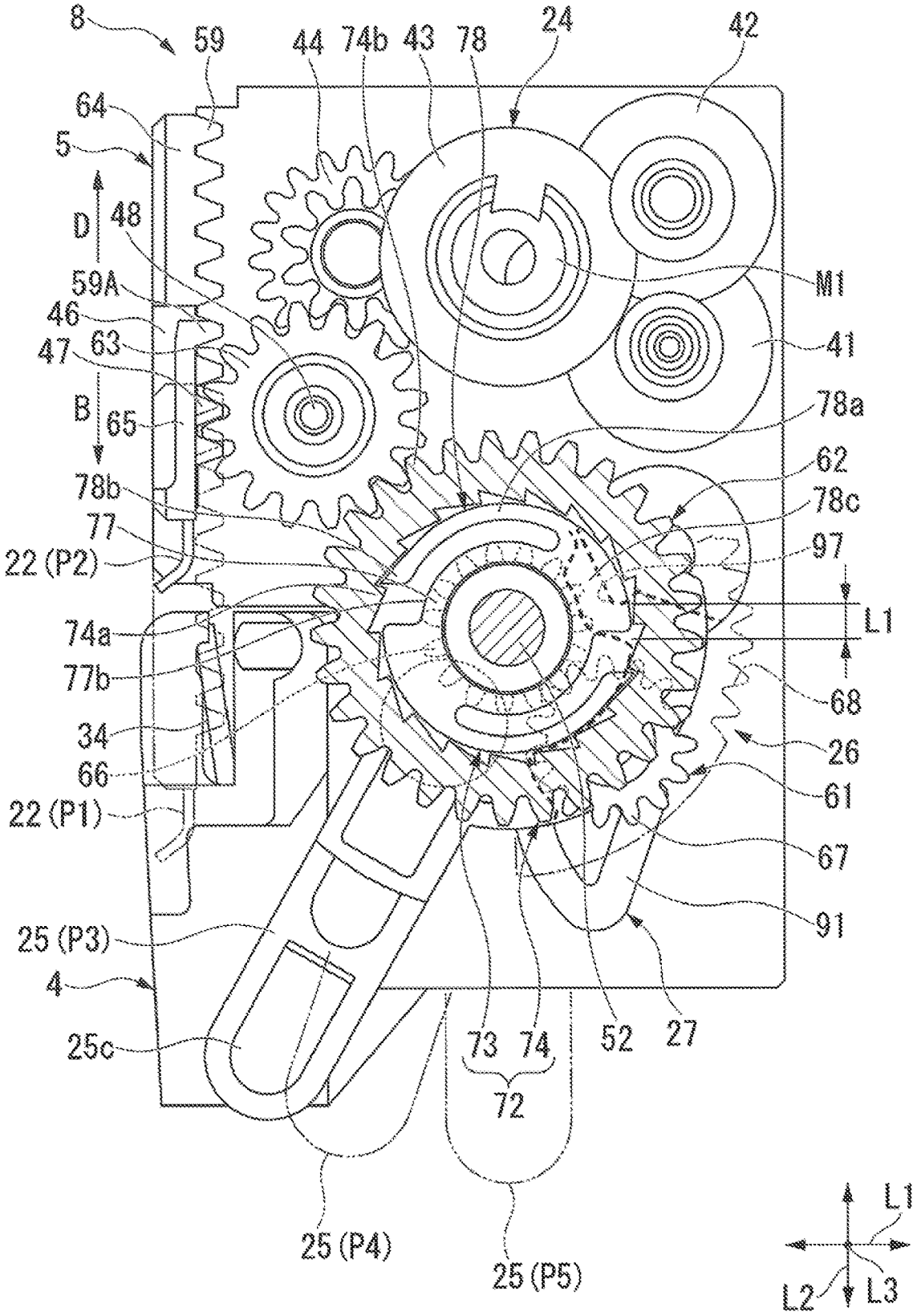
FIG. 5 is a sectional view of the printing unit illustrated in FIG. 3, taken along the line V-V.

As illustrated in FIG. 3 and FIG. 5, the drive mechanism 24 is a mechanism configured to move the movable blade 22 to a cutting position P1 and a standby position P2. The cutting position P1 is a position at which the movable blade 22 rides on the fixed blade 34 to cut the recording sheet P together with the fixed blade 34 (see FIG. 4). The standby position P2 is a position at which the movable blade 22 is separated from the fixed blade 34 (see FIG. 3). Specifically, the drive mechanism 24 includes a motor M1 for driving, first to fourth drive teeth 41 to 44, drive pinions 45, and the drive racks 46.

The motor M1 for driving is a motor capable of performing forward and reverse rotation. The first drive teeth 41 are coupled to a drive shaft of the motor M1 for driving. The first drive teeth 41 are coupled to the drive pinion 45 through intermediation of the second to fourth drive teeth 42 to 44. The drive pinion 45 is coaxially mounted on a pinion support shaft 48. The pinion support shaft 48 rotates integrally with the drive pinion 45. The drive pinions 45 are provided as a pair respectively on both sides in the right-and-left direction L3. The pair of drive pinions 45 are meshed with the drive racks 46 provided respectively on both sides in the right-and-left direction L3. The pair of drive pinions 45 are coupled to each other with the pinion support shaft 48.

Each of the drive racks 46 has a plurality of drive rack teeth 47 formed from an end portion (upper end portion) on the standby position P2 side to an end portion (lower end portion) on the cutting position P1 side. That is, the drive rack 46 has the drive rack teeth 47 formed in an entire region thereof. The drive racks 46 are mounted in both end portions of the movable blade holder 29 along the right-and-left direction L3 and extend along the up-and-down direction L2. That is, the movable blade 22 is mounted on the drive racks 46 through intermediation of the movable blade holder 29. Now, for ease of understanding of the configuration, the drive pinion 45 and the drive rack 46 on a side of the motor M1 for driving are described in detail, and description of the drive pinion 45 and the drive rack 46, which are located on a side opposite to the motor M1 for driving in the right-and-left direction L3, is herein omitted.

When the motor M1 for driving rotates forwardly, the rotation of the motor M1 for driving is transmitted to the drive pinion 45 through the first to fourth drive teeth 41 to 44. With this, the drive pinion 45 rotates in a direction of an arrow A illustrated in FIG. 3, and the drive rack 46 moves in a direction of an arrow B illustrated in FIG. 3 and FIG. 5 together with a return rack 64 (described later) of the return mechanism 26. When the drive rack 46 moves, the movable blade 22 linearly moves in the direction of the arrow B together with the drive rack 46. That is, the movable blade 22 can be moved to the cutting position P1.

Meanwhile, when the motor M1 for driving rotates reversely, the rotation of the motor M1 for driving is transmitted to the drive pinion 45 through the first to fourth drive teeth 41 to 44. With this, the drive pinion 45 rotates in a direction of an arrow C illustrated in FIG. 3, and the drive rack 46 moves in a direction of an arrow D illustrated in FIG. 3 and FIG. 5. When the drive rack 46 moves, the movable blade 22 linearly moves in the direction of the arrow D together with the drive rack 46. With this, the movable blade 22 can be moved to the standby position P2.

Figure 6:
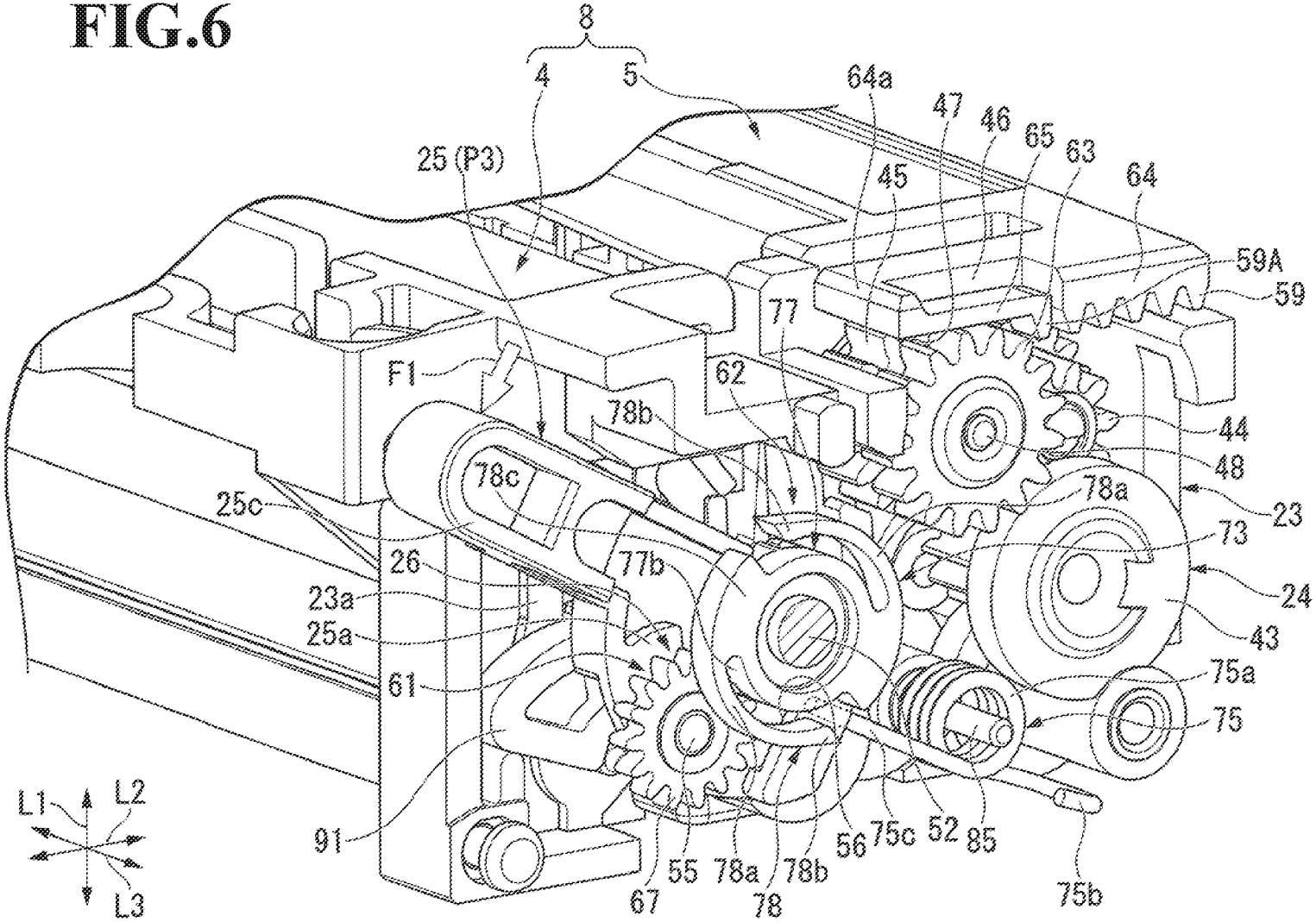
FIG. 6 is a perspective view for illustrating a main part of the printing unit illustrated in FIG. 3.
Figure 7:
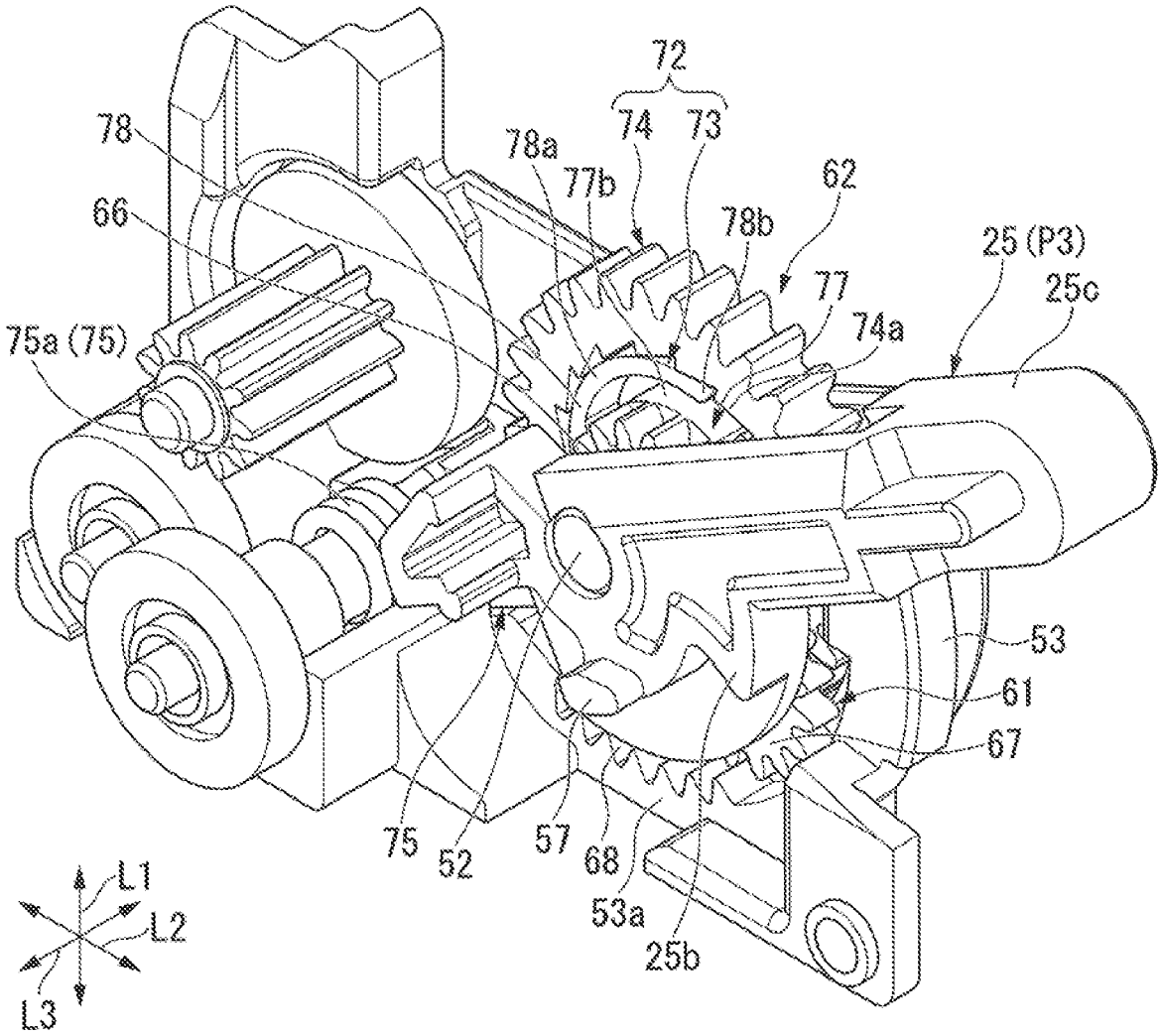
FIG. 7 is a perspective view for illustrating a return mechanism and an operation lever of the printing unit illustrated in FIG. 3.

As illustrated in FIG. 6 and FIG. 7, the operation lever 25 is pivotably supported on the side wall portion 23*a* side of the head frame 23 through intermediation of a lever support shaft 52. The operation lever 25 is configured so as to be able to perform a pushing operation backwardly (in the direction of the arrow BA) from a lock position P3 to an abutment position P4 or a releasing position P5 about the lever support shaft 52 by an operation force F1 illustrated in FIG. 6. The lever support shaft 52 projects inward from an exterior cover 53 of the casing 2.

The lock position P3 is a position at which the platen unit 4 is kept in a locked state with respect to the head unit 5. The abutment position P4 is a position at which a lever projecting portion 57 of the operation lever 25, which is described later, comes into abutment against a cam projecting portion 97 of a release cam 91 described later. The releasing position P5 is a position at which the locked state of the platen unit 4 to the head unit 5 is released.

As illustrated in FIG. 6, the operation lever 25 has an outer surface 25*a* on which an engagement groove portion 56 is formed. A planetary shaft 55 is provided so as to project outward from the outer surface 25*a*. Further, as illustrated in FIG. 7, the operation lever 25 has an inner surface 25*b*, from which the lever projecting portion 57 projects inward. The planetary shaft 55, the engagement groove portion 56, and the lever projecting portion 57 are described later in detail.

Further, the operation lever 25 is rotatably supported coaxially with a clutch member 73 and a sun gear 66, which are described later, through intermediation of the lever support shaft 52. Specifically, the clutch member 73 and the sun gear 66 are rotatably supported coaxially with a rotation axis of the operation lever 25. The clutch 73 and the sun gear 66 are members forming a part of the return mechanism 26.

A distal end portion 25*c* of the operation lever 25 is fitted on an inner side of a coupling member 16 (see FIG. 2) of the operation lever 13. Thus, the operation lever 25 is operated in association with the operation of the operation lever 13. With the operation described above, when the operation lever 13 is operated from a lock position to a release position, the operation lever 25 is operated from the lock position P3 to the releasing position P5.

Figure 8:
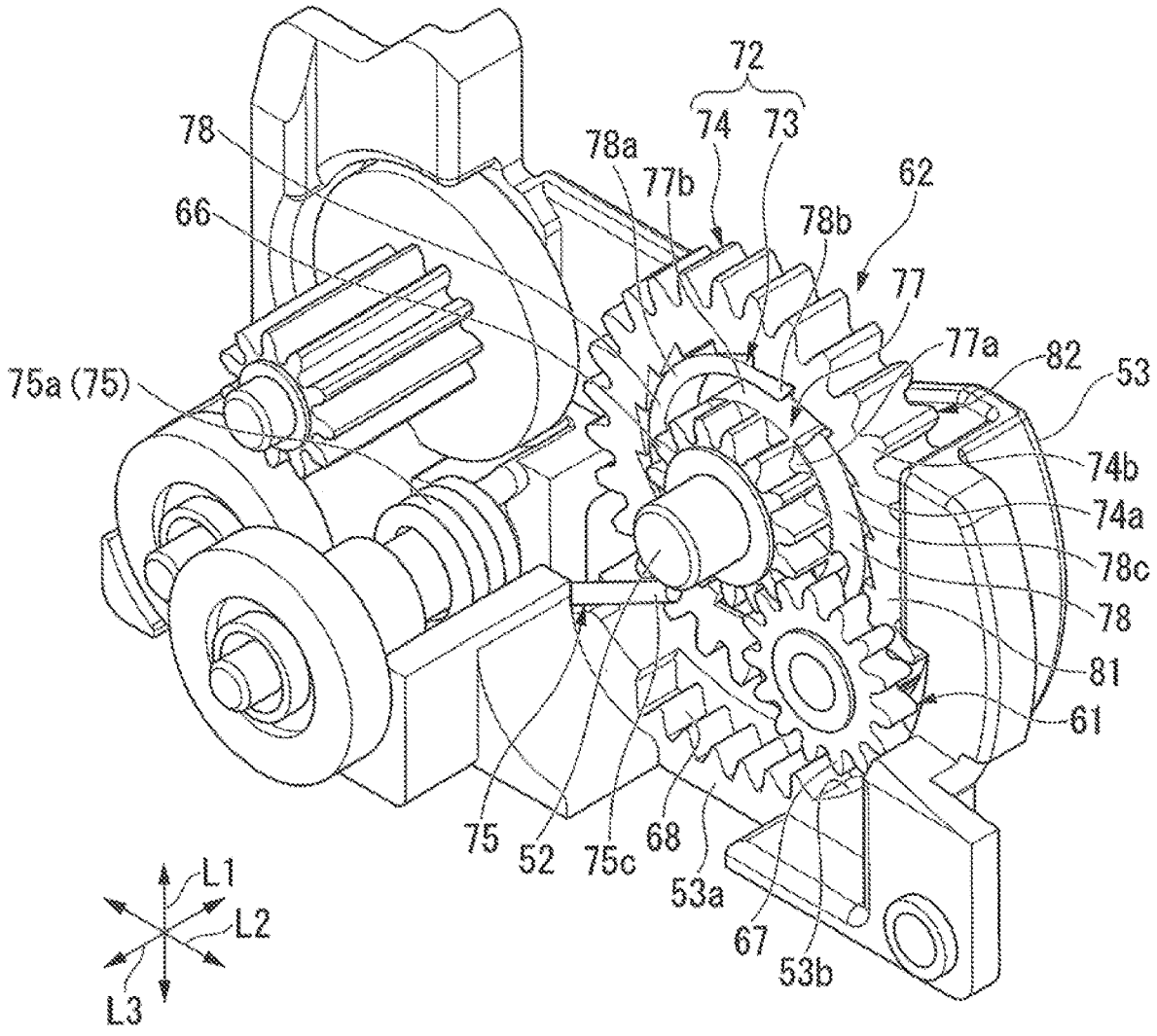
FIG. 8 is a perspective view for illustrating the return mechanism of the printing unit illustrated in FIG. 3.

As illustrated in FIG. 5, the return mechanism 26 is configured to return the movable blade 22 from the cutting position P1 toward the standby position P2 side. More specifically, as illustrated in FIG. 5 and FIG. 8, the return mechanism 26 mainly includes an acceleration mechanism 61, a lever returning mechanism 62, a return pinion 63, and the return rack 64.

The return mechanism 26 moves the movable blade 22 toward the standby position P2 side in association with the operation lever 25 under a state in which the movable blade 22 is stopped at the cutting position P1 due to occurrence of a paper jam. The acceleration mechanism 61 includes the sun gear 66, a planetary gear 67, and an internal gear 68. The sun gear 66 is rotatably supported by the lever support shaft 52 so as to be operated together with the clutch member 73 of a ratchet mechanism 72 described later. The sun gear 66 is formed integrally with an inner surface 77*a* of a clutch base 77, and is arranged coaxially with the clutch member 73. Specifically, the sun gear 66 and the ratchet mechanism 72 are rotatably supported coaxially with a rotation center of the operation lever 25. The planetary gear 67 is arranged so as to be meshed with the sun gear 66.

The planetary gear 67 is rotatably supported by the operation lever 25 through intermediation of the planetary shaft 55 (see FIG. 6). The planetary shaft 55 is arranged at a position offset from the lever support shaft 52. Thus, through the rotation of the operation lever 25 about the lever support shaft 52, the planetary shaft 55 (specifically, the planetary gear 67) follows movement of the operation lever 25 to revolve about the lever support shaft 52.

The internal gear 68 is provided so as to be able to mesh with the planetary gear 67. The internal gear 68 is formed in an arc shape on an inner periphery of a cover curved portion 53*a*. The cover curved portion 53*a* is formed integrally with the exterior cover 53, which covers a corresponding side portion of the printing unit 8 (see FIG. 6).

The internal gear 68 is formed so as to avoid meshing with the planetary gear 67 under a state in which the operation lever 25 is located at the lock position P3. Specifically, under a state in which the operation lever 25 is located at the lock position P3, the planetary gear 67 is arranged on an inner peripheral portion 53*b* of the cover curved portion 53*a*. As a result, under a state in which the operation lever 25 is located at the lock position P3, idling of the planetary gear 67 is permitted.

With the acceleration mechanism 61 having the configuration described above, as a result of the operation of the operation lever 25 from the lock position P3 toward the abutment position P4 or the releasing position P5, the planetary gear 67 follows the movement of the operation lever 25 to revolve toward the internal gear 68. Through the revolution of the planetary gear 67, the planetary gear 67 is meshed with the internal gear 68. With a further operation of the operation lever 25, the planetary gear 67 rotates while meshing with the internal gear 68. With the rotation of the planetary gear 67, the sun gear 66 follows the movement of the operation lever 25 to be rotated.

The lever returning mechanism 62 includes the ratchet mechanism 72 and a biasing member 75. The ratchet mechanism 72 includes the clutch member 73 and a ratchet wheel 74.

When the operation lever 25 is operated from the lock position P3 toward the abutment position P4 or the releasing position P5 under a state in which the movable blade 22 is stopped at the cutting position P1, the lever returning mechanism 62 transmits the operation force (pressing force) F1 of the operation lever 25 to the drive mechanism 24. Specifically, the operation force F1 is transmitted to the drive rack 46 via the return rack 64. With the transmission of the operation force F1 to the drive mechanism 24, the movable blade 22 is moved toward the standby position P2. Further, the lever returning mechanism 62 returns the operation lever 25, which has been operated to the abutment position P4 or the releasing position P5, to the lock position P3 with use of the biasing member 75.

As illustrated in FIG. 6 and FIG. 8, the clutch member 73 includes the clutch base 77 and a pair of clutch tooth portions (first engagement portions according to the present invention) 78. The clutch base 77 has an inner surface 77*a* having a disc shape. On the inner surface 77*a*, the sun gear 66 is formed coaxially and integrally with the clutch base 77. The clutch base 77 is supported by the lever support shaft 52 so as to be rotatable together with the sun gear 66. The pair of clutch tooth portions 78 are formed on an outer peripheral portion 77*b* of the clutch base 77 so as to be axially symmetric and integral with the clutch base 77.

Each of the clutch tooth portions 78 includes an arm portion 78*a* and a meshing claw 78*b*. The arm portion 78*a* has an arm base portion 78*c*, which is formed on the outer peripheral portion 77*b* of the clutch base 77 so as to be integral with the clutch base 77. The arm portion 78*a* is arranged so that the arm base portion 78*c* is apart from the outer peripheral portion 77*b* by a given distance.

Specifically, the arm portion 78*a* extends in a counterclockwise direction in a curved manner from the arm base portion 78*c* along the outer peripheral portion 77*b* of the clutch base 77 to the meshing claw 78*b* when viewed from an outer side in the right-and-left direction L3. Specifically, the arm portion 78*a* is supported at the arm base portion 78*c* in a cantilever manner on the outer peripheral portion 77*b* of the clutch base 77, and is formed so as to be elastically deformable toward the outer peripheral portion 77*b* about the arm base portion 78*c* as a fulcrum. The meshing claw 78*b* is formed at a distal end of the arm portion 78*a*. The meshing claw 78*b* is formed to project in the counterclockwise direction so that a distal end on a radially outer side can be meshed with internal teeth 74*a* (described later) of the ratchet wheel 74.

As illustrated in FIG. 5 and FIG. 8, the clutch base 77 is supported integrally with the sun gear 66 so as to be rotatable with respect to the lever support shaft 52. Thus, the clutch member 73 is rotatably supported by the lever support shaft 52. The operation lever 25, the sun gear 66, and the clutch member 73 are supported by the lever support shaft 52 so that respective rotation centers of the operation lever 25, the sun gear 66, and the clutch member 73 are arranged coaxially. The clutch member 73 is formed coaxially and integrally with the sun gear 66 so as to operate together with the sun gear 66.

The sun gear 66 follows the movement of the operation lever 25 to be rotated. Thus, the clutch member 73 follows the movement of the operation lever 25 to be rotated together with the sun gear 66. The ratchet wheel 74 is arranged so as to be able to mesh with the clutch member 73.

The ratchet wheel 74 includes a wheel base 81 (see FIG. 3) and a ratchet portion 82. The wheel base 81 is formed in a disc shape so as to be coaxial with the sun gear 66 and the clutch member 73. The wheel base 81 is arranged on the outer side of the clutch member 73 in the right-and-left direction L3. Similarly to the sun gear 66 and the clutch member 73, the wheel base 81 is rotatably supported by the lever support shaft 52. The ratchet portion 82 is formed on an outer peripheral portion of the wheel base 81 so as to be coaxial with the wheel base 81 and integral with the wheel base 81.

The ratchet portion 82 is formed in an annular shape so as to cover a radially outer side (specifically, the pair of clutch tooth portions 78) of the clutch member 73, and is arranged coaxially with the clutch member 73. The ratchet portion 82 has the plurality of internal teeth 74*a* (second engagement portions according to the present invention) and a plurality of external teeth 74*b*. The internal teeth 74*a* are formed on an inner peripheral surface of the ratchet portion 82 in an annular pattern, and the external teeth 74*b* are formed on an outer peripheral surface of the ratchet portion 82 in an annular pattern.

The number of internal teeth 74*a* and the number of external teeth 74*b* are suitably selected in consideration of an operation amount (operation stroke amount) of the operation lever 25. The external teeth 74*b* are formed on the outer peripheral surface of the ratchet portion 82, and are meshed with the return pinion 63. The internal teeth 74*a* are formed so as to be meshed with the meshing claw 78*b* through the rotation of the clutch member 73 in the counterclockwise direction when viewed from the outer side in the right-and-left direction L3. Specifically, the clutch member 73 and the ratchet wheel 74 form a meshing clutch in which the pair of meshing claws 78*b* and the internal teeth 74 are meshed with each other to couple the clutch member 73 and the ratchet wheel 74 to each other.

Thus, when the operation lever 25 is operated from the lock position P3 toward the side of the abutment position P4 or the release position P5, the sun gear 66 is rotated in the counterclockwise direction when viewed from the outer side in the right-and-left direction L3. As a result, the clutch member 73 is rotated in the counterclockwise direction together with the sun gear 66. The meshing claws 78*b* of the clutch member 73 are engaged with the internal teeth 74*a* of the ratchet wheel 74, and the ratchet wheel 74 is rotated in the counterclockwise direction together with the clutch member 73.

The ratchet wheel 74 is individually rotated by the acceleration mechanism 61 with respect to the operation lever 25. Thus, a large rotation amount of the ratchet wheel 74 can be ensured for the operation stroke amount of the operation lever 25. Specifically, a rotation amount of the ratchet wheel 74, which is required to return the movable blade 22 to the standby position P2, can be ensured under a state in which the operation stroke amount of the operation lever 25 is suppressed. In this manner, when the movable blade 22 is returned to the standby position P2, high operability of the operation lever 25 can be ensured.

Further, through the clockwise rotation of the clutch member 73 when viewed from the outer side in the right-and-left direction L3, the meshing claws 78*b* climb over the internal teeth 74*a* with the elastic deformation of the arm portions 78*a*. Thus, through the clockwise rotation of the clutch member 73, the meshing of the internal teeth 74*a* with the meshing claws 78*b* is released. The meshing between the internal teeth 74*a* and the meshing claws 78*b* is released to allow the clutch member 73 to idle in the clockwise direction.

The operation lever 25 is configured to return from the abutment position P4 or the releasing position P5 toward the lock position P3 by a biasing force of the biasing member 75. When the operation lever 25 is returned toward the lock position P3, the sun gear 66 is rotated in the clockwise direction when viewed from the outer side in the right-and-left direction L3 through intermediation of the planetary gear 67. Thus, the clutch member 73 follows the movement of the operation lever 25 to be rotated in the clockwise direction together with the sun gear 66. At this time, the meshing between the internal teeth 74*a* and the meshing claws 78*b* is released to allow the clutch member 73 to idle in the clockwise direction.

Hereinafter, when the clutch member 73 is viewed from the outer side in the right-and-left direction L3, the rotation of the clutch member 73 in the counterclockwise direction is simply referred to as "counterclockwise rotation", and the rotation of the clutch member 73 in the clockwise direction is simply referred to as "clockwise rotation".

As illustrated in FIG. 6, the biasing member 75 includes a coil portion 75*a*, a first end portion 75*b*, and a second end portion 75*c*. The coil portion 75*a* is supported by a support pin 85. The first end portion 75*b* is locked to the exterior cover 53. The second end portion 75*c* is locked in the locking groove portion 56 of the operation lever 25. With the configuration described above, the operation lever 25 is kept in a state of abutting against a lever stopper (not shown) with the biasing force of the biasing member 75 to be positioned at the lock position P3. However, the biasing member 75 is not limited to the configuration described above, and may be, for example, a flat spring.

Further, as a result of removal of the operation force F1 from the operation lever 25 under a state in which the operation lever 25 is operated from the lock position P3 to the abutment position P4 or the releasing position P5 against the biasing force of the biasing member 75, the operation lever 25 is returned to the lock position P3 with an elastic restoring force (biasing force) of the biasing member 75.

As illustrated in FIG. 5, the external teeth 74*b* of the ratchet wheel 74 are meshed with the return pinion 63. As illustrated in FIG. 6, the return pinion 63 is arranged coaxially with the drive pinion 45 on an outer side thereof, and is rotatably supported by the pinion support shaft 48. The return pinion 63 operates in association with rotation of the ratchet wheel 74 to be rotated about the pinion support shaft 48. The ratchet wheel 74 is coupled to the operation lever 25 so as to be able to operate in association with the operation lever 25. The return pinion 63 is coupled to the operation lever 25 so as to be able to operate in association with the operation lever 25.

The return pinion 63 is formed so as to be meshed with a plurality of rack teeth 59 of the return rack 64. The return rack 64 is formed integrally with the drive rack 46 in a state of being arranged on an outer side of the drive rack 46 of the drive mechanism 24. The return rack 64 has the rack teeth 59 formed only on a side opposite to the blade edge 22*b* (see FIG. 3) of the movable blade 22. Thus, the return rack 64 is meshed with the return pinion 63 when the movable blade 22 is located at the cutting position P1, and the meshing of the return rack 64 with the return pinion 63 is released when the movable blade 22 is located at the standby position P2.

The ratchet wheel 74 is coupled to the operation lever 25 so as to be able to operate in association with the operation lever 25 through intermediation of the clutch member 73. Thus, with the operation of the operation lever 25, the movable blade 22 can be reliably returned to the standby position P2 through intermediation of the clutch member 73, the ratchet wheel 74, the return pinion 63, and the return rack 64.

Further, with the formation of the return rack 64 on the drive rack 46, the drive rack 46 and the return rack 64 can be formed integrally with each other. Thus, the return rack 64 can be formed without increasing the number of components. As a result, configurations of the printing unit 8 and the thermal printer 1 can be simplified, and at the same time, cost can be suppressed.

The rack tooth 59 among the plurality of rack teeth 59, which is located on the blade edge 22*b* (see FIG. 3) side of the movable blade 22, is displaceable. Hereinafter, the displaceable rack tooth 59 is simply referred to as "rack tooth 59A". The rack tooth 59A is formed at a distal end portion of a rack arm 65. A proximal end portion of the rack arm 65 is coupled to an end portion 64*a* of the return rack 64, which is located on the blade edge 22*b* side of the movable blade 22. The rack arm 65 is formed so as to be elastically deformable in a direction away from the return pinion 63 about the proximal end portion as a fulcrum. Thus, the rack tooth 59A can be retreated to a radially outer side of the return pinion 63 by elastically deforming the rack arm 65 in the direction away from the return pinion 63.

The reason why the rack tooth 59A of the return rack 64 is formed so as to be retreatable to the radially outer side of the return pinion 63 is now briefly described. For example, when the return rack 64 is moved in the direction of the arrow B illustrated in FIG. 3, it is conceivable that the rack tooth 59A of the return rack 64 comes into abutment against a corresponding one of tooth tips of the return pinion 63. In this case, there is a fear in that the movement of the return rack 64 may be blocked by the tooth tips of the return pinion 63. Thus, the rack tooth 59A is formed at the distal end portion of the rack arm 65. With the elastic deformation of the rack arm 65, the rack tooth 59A is retreated to the radially outer side of the return pinion 63 to climb over the corresponding tooth tip of the return pinion 63. After the rack tooth 59A climbs over the corresponding tooth tip of the return pinion 63, the rack tooth 59A returns to an original position with a restoring force of the rack arm 65. Then, the rack tooth 59A, which has returned to the original position, is meshed with a subsequent tooth tip of the return pinion 63. In this manner, the return pinion 63 can be suitably rotated by the rack teeth 59 of the return rack 64.

As illustrated in FIG. 5 and FIG. 8, the lever returning mechanism 62 includes the clutch member 73, the ratchet wheel 74, and the biasing member 75. Thus, when the operation lever 25 is operated toward the abutment position P4 or the releasing position P5, the clutch member 73 can be meshed with the internal teeth 74*a* of the ratchet wheel 74 to rotate the ratchet wheel 74. In this manner, motive power (operation force F1) generated along with the operation of the operation lever 25 can be transmitted from the return pinion 63 to the return rack 64 (specifically, the drive mechanism 24) through intermediation of the external teeth 74*b* of the ratchet wheel 74.

Meanwhile, in a case in which the movable blade 22 has not been returned to the standby position P2 due to occurrence of a paper jam, after the operation lever 25 is operated to, for example, the abutment position P4, the operation force F1 is removed from the operation lever 25. Then, the operation lever 25 is likely to return toward the lock position P3 with the elastic restoring force of the biasing member 75. However, the ratchet wheel 74 is restricted from rotating and is placed in a stationary state. Thus, the clutch member 73 idles without being meshed with the internal teeth 74*a* of the ratchet wheel 74. In this manner, the clutch member 73 can idle while the ratchet wheel 74 is kept in the stationary state. As a result, the operation lever 25 can be returned to the lock position P3 under a state in which the movable blade 22 is kept at a position in the middle of a way to the standby position P2. Thus, the operation lever 25 can be operated again from the lock position P3 toward the abutment position P4 side. Thus, the operation lever 25 can be repeatedly operated a number of times, and the movable blade 22 can be reliably returned to the standby position P2.

As described above, with a simple configuration in which the lever returning mechanism 62 includes the clutch member 73, the ratchet wheel 74, and the biasing member 75, the paper jam, which has occurred between the fixed blade 34 and the movable blade 22 can easily be eliminated. Further, with the simple configuration, the operation stroke amount at the time of operation of the operation lever 25 from the lock position P3 to the releasing position P5 can be suppressed. The operation stroke amount corresponds to a travel distance of the operation lever 25 when the operation lever 25 is operated from the lock position P3 to the releasing position P5.

Figure 9:
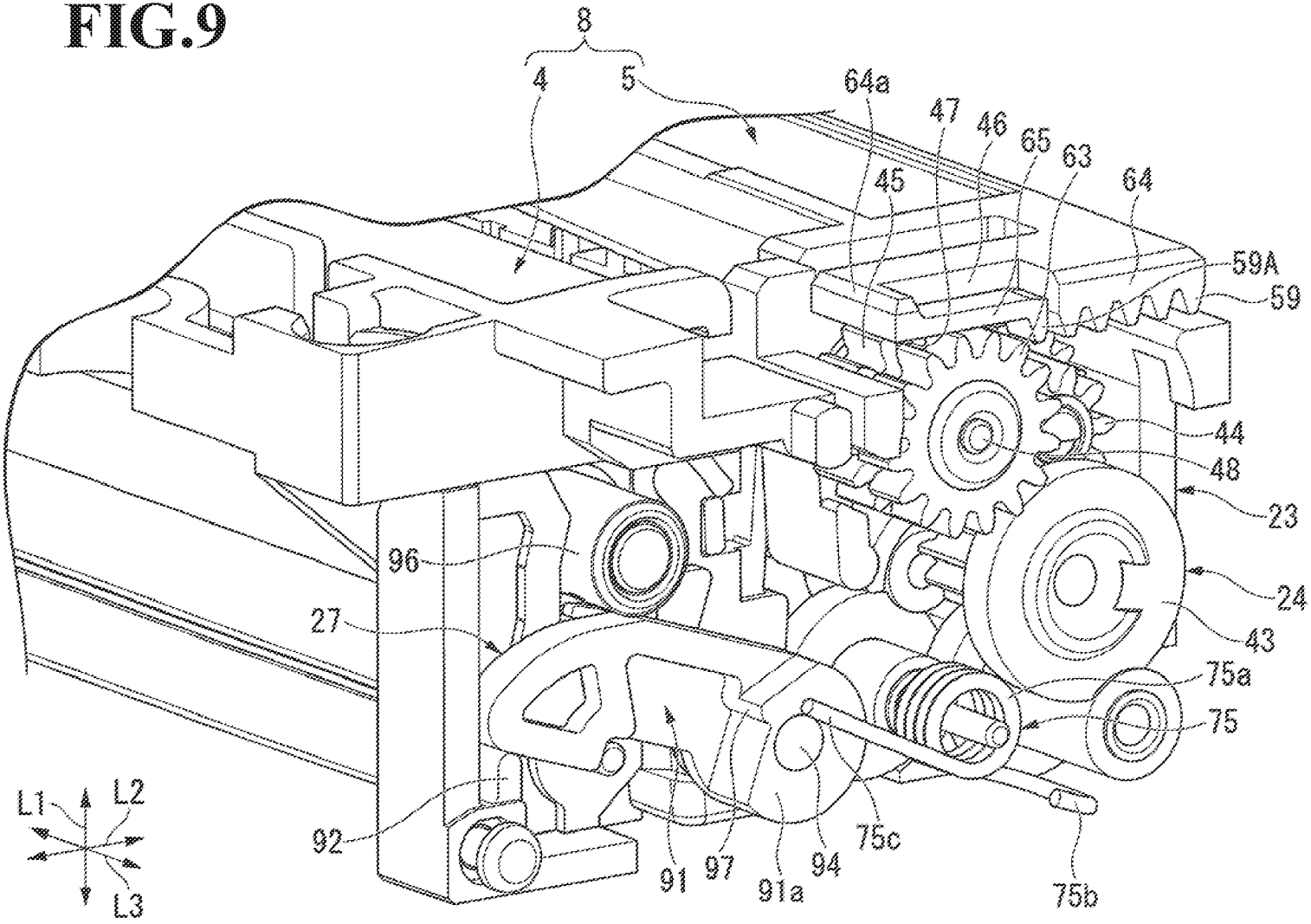
FIG. 9 is a perspective view for illustrating an unlocking mechanism of the printing unit illustrated in FIG. 3.

As illustrated in FIG. 5 and FIG. 9, the unlocking mechanism 27 is arranged on an inner side of the operation lever 25. The unlocking mechanism 27 is configured to unlock the printer cover 3 in association with a pivoting operation of the operation lever 25. Specifically, the platen unit 4 is unlocked from the head unit 5 with use of the operation lever 25. The unlocking mechanism 27 includes the release cam 91, the lever projecting portion 57, and a cam stopper 92.

The release cam 91 is arranged on the inner side of the operation lever 25. The release cam 91 has a base portion 91*a* rotatably supported by a cam shaft 94. The cam shaft 94 is formed so as to project outward from the casing 2. The release cam 91 is sandwiched between the cam stopper 92 and a bearing 96 to be kept in a stationary position (state illustrated in FIG. 9). The bearing 96 functions as a bearing configured to rotatably support the platen roller 33.

The release cam 91 has the cam projecting portion 97 formed so as to project downward. The lever projecting portion 57 illustrated in FIG. 7 is arranged at a position lower than the cam projecting portion 97. The lever projecting portion 57 is formed on the operation lever 25 so as to be opposed to the cam projecting portion 97.

Figure 10:
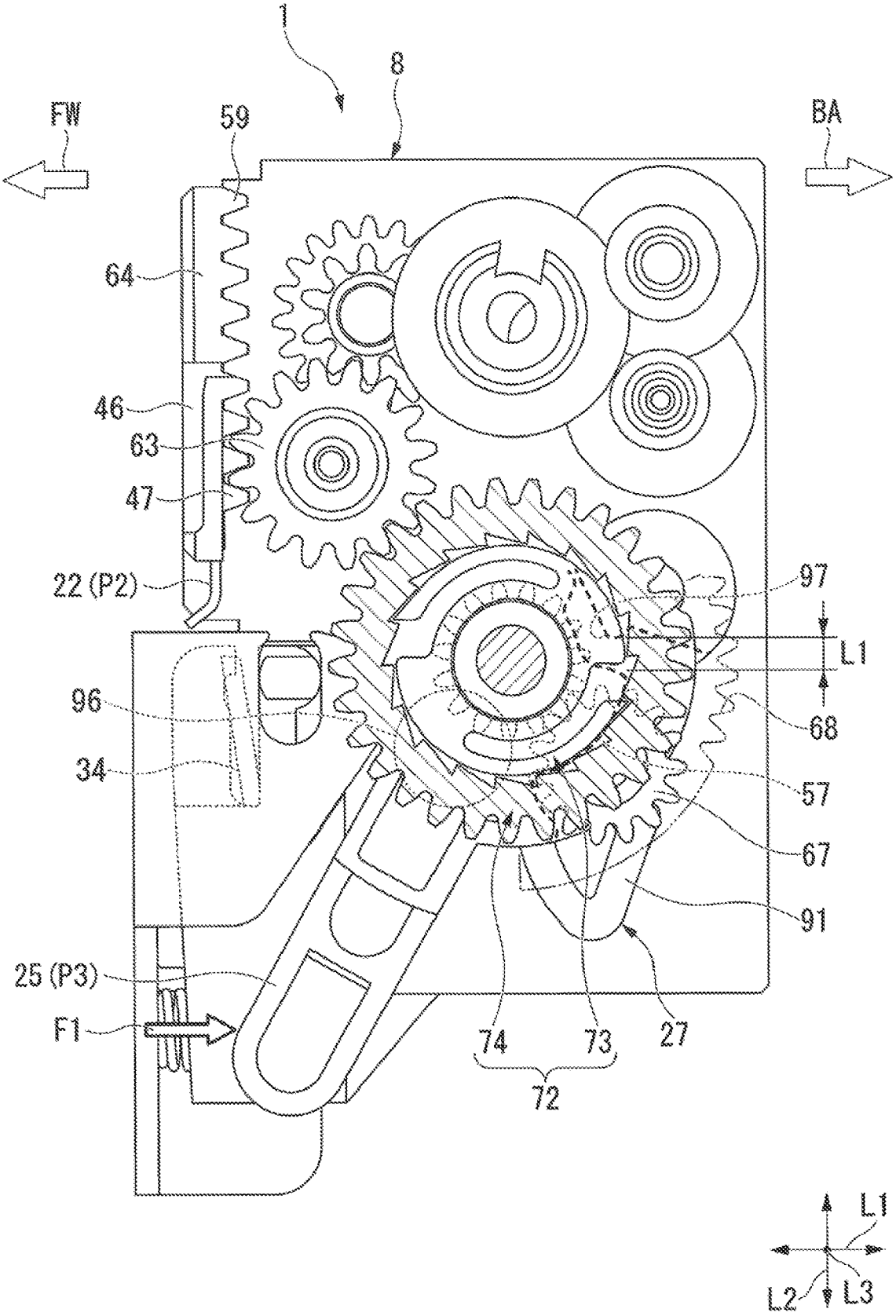
FIG. 10 is a sectional view of the printing unit under a state in which the movable blade is located at a standby position.

As illustrated in FIG. 10, under a state in which the release cam 91 is located at the stationary position and the operation lever 25 is located at the lock position P3, a projecting portion distance L1 between the lever projecting portion 57 and the cam projecting portion 97 is set relatively small. Then, when the operation lever 25 is operated from the lock position P3 to the abutment position P4, the lever projecting portion 57 is brought into abutment against the cam projecting portion 97. Further, when the operation lever 25 is operated to the releasing position P5 beyond the abutment position P4, the release cam 91 is moved from the stationary position to a release position about the cam shaft 94. In this manner, the bearing 96 can be lifted up with use of the release cam 91, and the platen unit 4 can be unlocked from the head unit 5.

By setting the projecting portion distance L1 between the lever projecting portion 57 and the cam projecting portion 97 relatively small, when the printer cover 3 is unlocked with use of the operation lever 25 under a state in which the movable blade 22 is located at the standby position P2, the operation stroke amount of the operation lever 25 can be suppressed.

Further, the rack teeth 59 are formed only on the side opposite to the blade edge 22*b* of the movable blade 22. Thus, after the printer cover 3 is unlocked, the meshing between the rack teeth 59 of the return rack 64 and the return pinion 63 is released. Therefore, when the printer cover 3 is unlocked with use of the operation lever 25 under a state in which the movable blade 22 is located at the standby position P2, the return pinion 63 can idle. Thus, the movable blade 22 can be kept at the standby position P2.

As described above, with the printing unit 8 according to this embodiment, when the movable blade 22 is stopped at the cutting position P1 due to a paper jam having occurred between the fixed blade 34 and the movable blade 22, the operation lever 25 is operated from the lock position P3 toward the abutment position P4 and the releasing position P5. In this manner, the return mechanism 26 can be operated in association with the operation lever 25. Specifically, when the operation lever 25 is operated from the lock position P3 toward the abutment position P4 and the releasing position P5, the motive power (operation force F1) generated along with the operation of the operation lever 25 can be transmitted to the drive mechanism 24 by the return mechanism 26. Thus, the movable blade 22 can be moved toward the standby position P2. Further, the return mechanism 26 includes the lever return mechanism 62. Hence, the operation lever 25, which has been operated, can be returned from the side of the abutment position P4 and the releasing position P5 to the lock position P3. Therefore, the operation lever 25 can be operated again from the lock position P3 toward the abutment position P4 and the releasing position P5, and the movable blade 22 can be further moved toward the standby position P2 by the return mechanism 26.

Accordingly, the operation lever 25 can be repeatedly operated a number of times from the lock position P3 toward the side of the abutment position P4 and the releasing position P5. In addition, every time the operation lever 25 is operated, the movable blade 22 can be moved toward the standby position P2. Therefore, the movable blade 22 can be reliably moved to the standby position P2 through a number of operations of the operation lever 25. Thus, a state in which the movable blade 22 rides on the fixed blade 34 can be cancelled. Thus, at a timing at which the riding of the movable blade 22 on the fixed blade 34 is cancelled, the operation lever 25 can be moved to the releasing position P5, and the platen unit 4 can be unlocked. As a result, the paper jam, which has occurred between the fixed blade 34 and the movable blade 22, can be eliminated.

In particular, the operation lever 25 can be repeatedly operated a number of times from the lock position P3 toward the side of the abutment position P4 and the releasing position P5. At the same time, the movable blade 22 can be moved toward the standby position P2 side every time the operation lever 25 is operated. Thus, the operation stroke amount of each operation of the operation lever 25 can be suppressed. In a normal case in which the movable blade 22 is located at the standby position P2 without occurrence of a paper jam, the platen unit 4 can be unlocked without operating the operation lever 25 by a large amount. Thus, downsizing and improvement of ease of layout of the thermal printer 1 in which the printing unit 8 is to be mounted can be achieved. Further, the operation lever 25 configured to unlock the platen unit 4 is operated in association with the return mechanism 26, and thus can also serve as a lever for eliminating a paper jam. With the configuration described above, increase in number of the components can be suppressed, and simplification of the configuration can be achieved.

Further, the fixed blade 34 is provided to the printer cover 3, and the movable blade 22 is provided to the casing 2. Thus, the drive mechanism 24 configured to drive the movable blade 22 is not required to be provided to the printer cover 3. With the configuration described above, reduction in weight of the printer cover 3 can be achieved, and high operability for opening and closing the printer cover 3 can be ensured.

Now, an operation of operating the operation lever 25 of the thermal printer 1 to unlock the printer over 3 so as to open the printer cover 3 is described with reference to FIG. 10 to FIG. 16. The operation lever 25 configured to operate the return mechanism 26 is configured to operate in association with the operation lever 13. In FIG. 10 to FIG. 16, however, for ease of understanding the operation of the return mechanism 26, the operation of the operation lever 25 is first described.

First, description is given of an operation of operating the operation lever 25 to unlock the platen unit 4 from the head unit 5 so as to open the printer cover 3 in a normal state (specifically, a state in which a paper jam does not occur) in which the movable blade 22 is located at the standby position P2.

As illustrated in FIG. 10, when the movable blade 22 is located at the standby position P2, the return pinion 63 is located at a position apart from the rack teeth 59 of the return rack 64. Under the above-mentioned state, the projecting portion distance L1 between the lever projecting portion 57 of the operation lever 25 and the cam projecting portion 97 of the release cam 91 is set relatively small.

Figure 11:
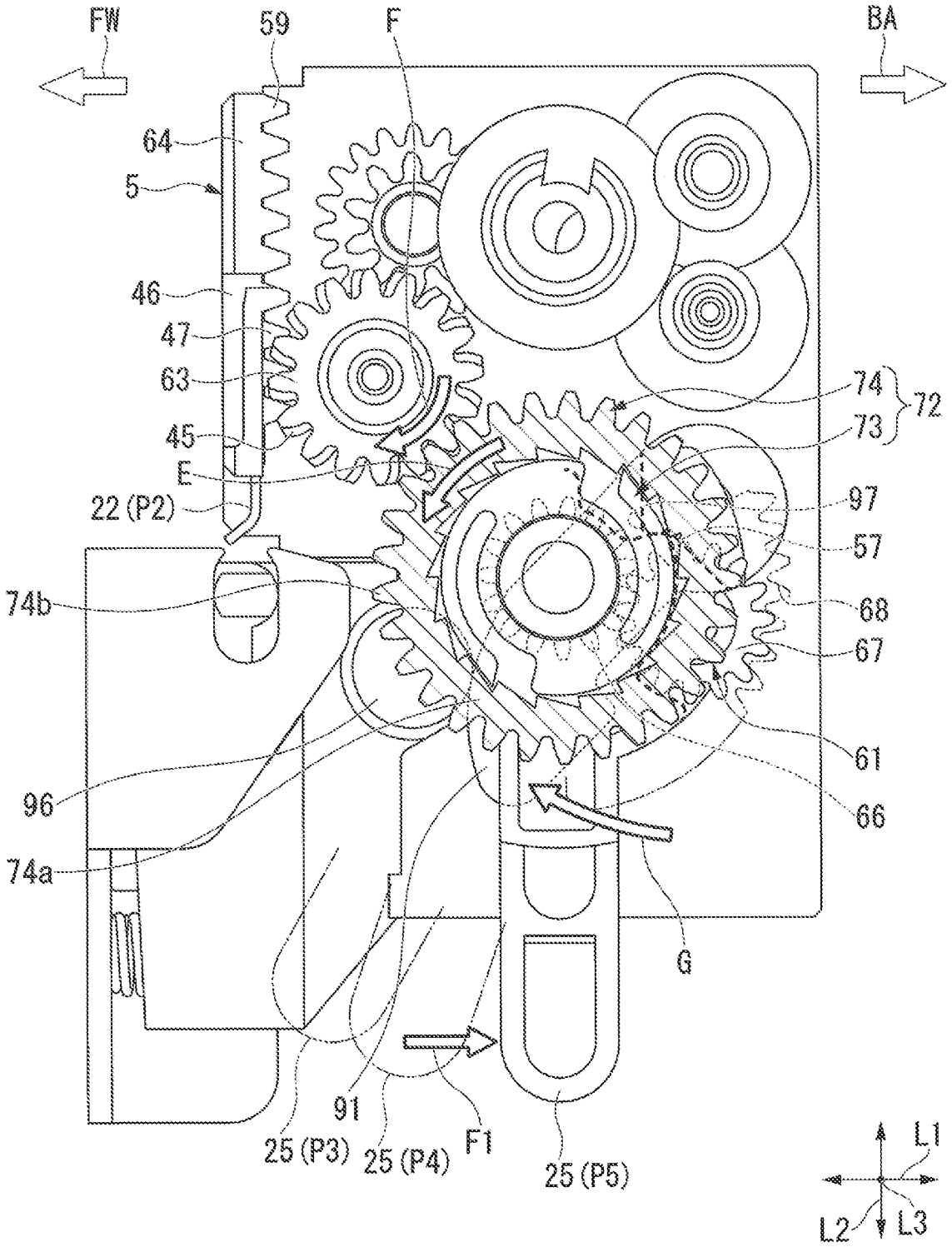
FIG. 11 is a sectional view for illustrating an operation in which the operation lever is operated from the state illustrated in FIG. 10 to unlock a platen unit.

When the operation force F1 is exerted on the operation lever 25 in the state illustrated in FIG. 10, the operation lever 25 is operated from the lock position P3 toward the side of the abutment position P4 and the releasing position P5 against the biasing force of the biasing member 75 as illustrated in FIG. 11. In this manner, the planetary gear 67 can be revolved toward the internal gear 68 along with the movement of the operation lever 25, and the planetary gear 67 can be meshed with the internal gear 68.

With the meshing described above, when the operation lever 25 is further operated, the planetary gear 67 can be rotated while being meshed with the internal gear 68. Then, through the rotation of the planetary gear 67, the sun gear 66 is rotated in the counterclockwise direction along with the movement of the operation lever 25. In this manner, the clutch member 73 can be rotated together with the sun gear 66 in a direction of an arrow E along with the rotation of the sun gear 66.

At this time, the clutch member 73 is meshed with the internal teeth 74*a* of the ratchet wheel 74. Thus, the ratchet wheel 74 can be rotated together with the clutch member 73 in the direction of the arrow E. Hence, the return pinion 63 meshing with the external teeth 74*b* of the ratchet wheel 74 can be rotated in a direction of an arrow F.

As described above, the return pinion 63 is located at the position apart from the rack teeth 59 of the return rack 64. Thus, the return pinion 63 can idle in a free state. As a result, the motive power is not transmitted from the operation lever 25 side to the return rack 64 side. Further, the ratchet wheel 74 is individually rotated by the acceleration mechanism 61 with respect to the operation lever 25. Thus, a large rotation amount of the ratchet wheel 74 for the operation stroke amount of the operation lever 25 can be ensured.

When the operation lever 25 is operated from the lock position P3 to the abutment position P4, the lever projecting portion 57 is brought into abutment against the cam projecting portion 97. Then, when the operation lever 25 is further operated to the releasing position P5 beyond the abutment position P4, the cam projecting portion 97 can be pushed up with use of the lever projecting portion 57. As a result, the release cam 91 can be moved from the stationary position illustrated in FIG. 10 in a direction of an arrow G to the release position. At the same time, the bearing 96 can be lifted up with use of the release cam 91. As a result, the platen unit 4 can be unlocked from the head unit 5, and the printer cover 3 can be opened.

The projecting portion distance L1 (see FIG. 10) between the lever projecting portion 57 of the operation lever 25 and the cam projecting portion 97 of the release cam 91 is set relatively small. Thus, the operation stroke amount at the time of operation of the operation lever 25 from the lock position P3 to the releasing position P5 can be suppressed.

Figure 12:
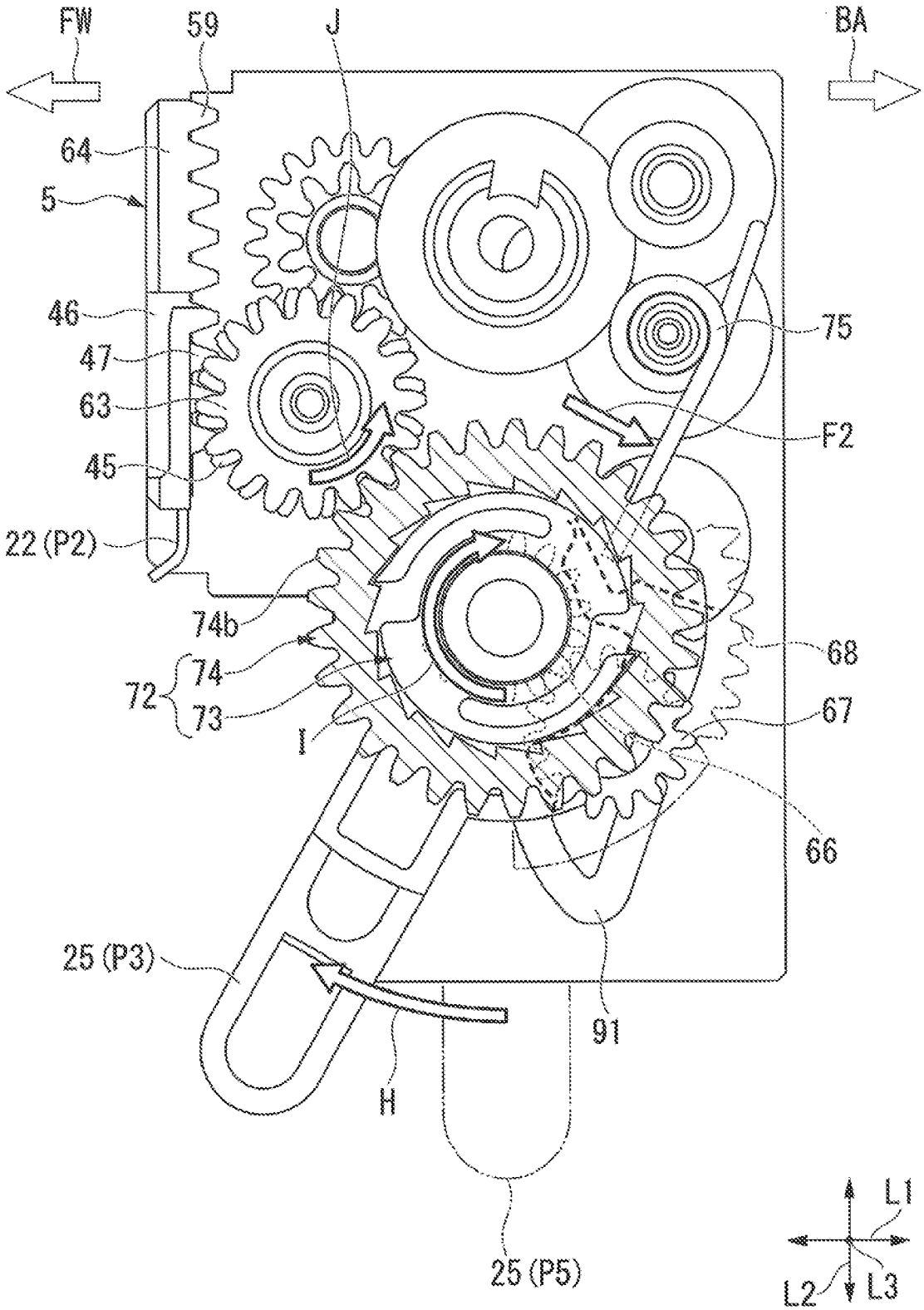
FIG. 12 is a sectional view for illustrating an operation in which the operation lever is returned to a lock position from the state illustrated in FIG. 11.

Subsequently, as illustrated in FIG. 12, after the platen unit 4 is unlocked, the operation force F1 exerted on the operation lever 25 is removed. As a result, the operation lever 25 can be moved in a direction of an arrow H from the releasing position P5 side toward the lock position P3 with use of an elastic restoring force (biasing force F2) of the biasing member 75. At this time, through the movement of the operation lever 25, the planetary gear 67 is rotated while being meshed with the internal gear 68. Further, through the rotation of the planetary gear 67, the sun gear 66 is rotated in the clockwise direction. In this manner, the clutch member 73 can be rotated in a direction of an arrow I together with the sun gear 66.

At this time, as described above, the return pinion 63 is arranged at the position apart from the rack teeth 59 of the return rack 64. Thus, a load from the return pinion 63 does not act on the external teeth 74*b* of the ratchet wheel 74. Thus, the ratchet wheel 74 can be rotated in the direction of the arrow I together with the clutch member 73. Through the rotation of the ratchet wheel 74, the return pinion 63 idles in a free state in a direction of an arrow J.

Based on the operation described above, the operation lever 25 can be returned to the lock position P3 with use of the elastic restoring force (biasing force F2) of the biasing member 75.

Next, with reference to FIG. 13 to FIG. 16, description is given of an operation of operating the operation lever 25 to unlock the platen unit 4 to open the printer cover 3 when a paper jam 95 occurs between the movable blade 22 and the fixed blade 34. With reference to FIG. 13 to FIG. 16, description is given of an example in which the operation of the operation lever 25 is repeated twice as a preferred number of repetitions of the operation.

Figure 13:
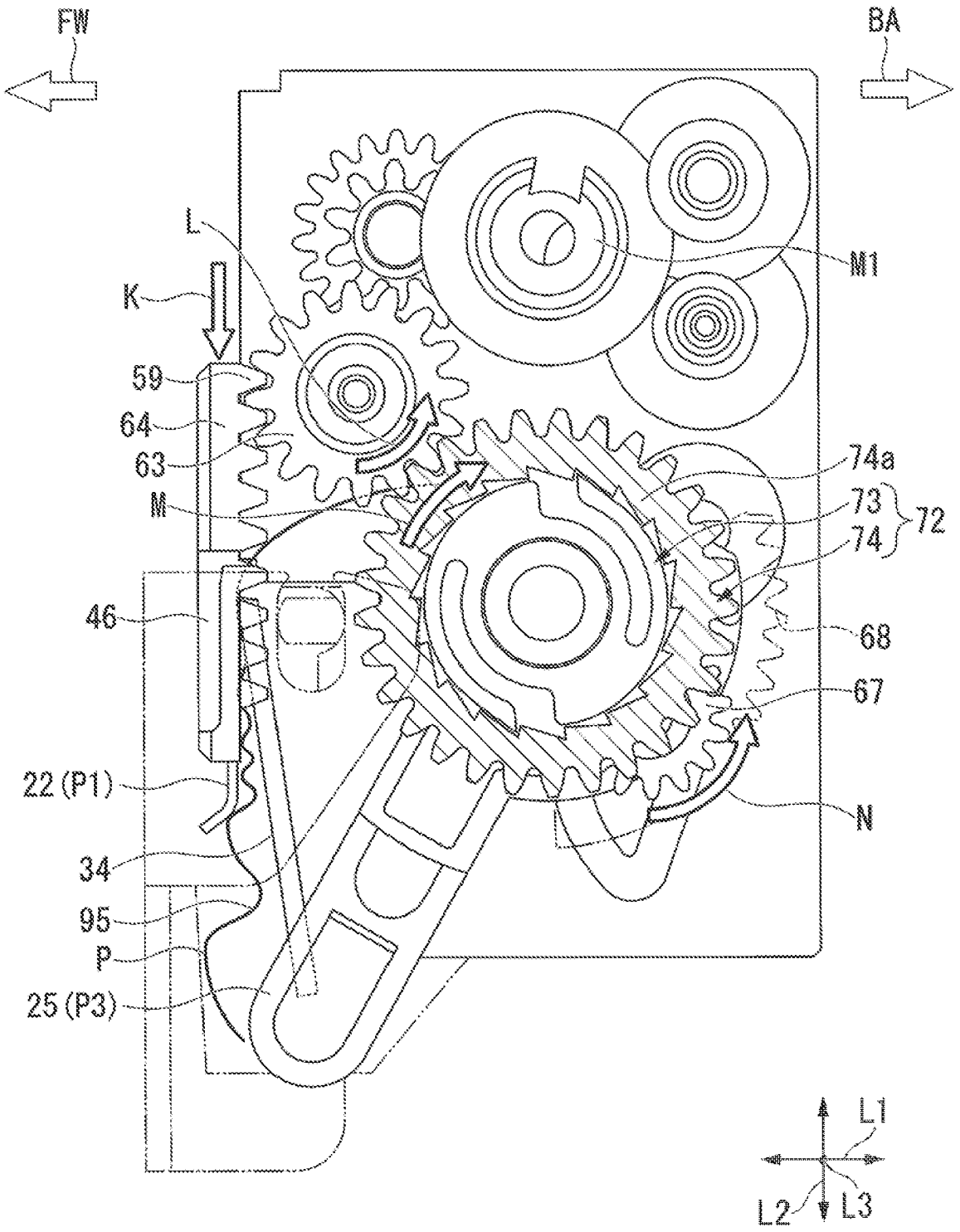
FIG. 13 is a sectional view for illustrating an operation which may cause a paper jam between the movable blade and the fixed blade.

As a stage prior to the occurrence of the paper jam 95, a motion of moving the movable blade 22 to the cutting position P1 to cut the recording sheet P is first briefly described. As illustrated in FIG. 13, when the operation lever 25 is located at the lock position P3, the meshing between the planetary gear 67 and the internal gear 68 is avoided, and thus the idling of the planetary gear 67 is permitted. Thus, the drive rack 46 can be moved by driving the motor M1 for driving to move the movable blade 22 in a direction of an arrow K to the cutting position P1. The return rack 64 is moved along with the movement of the drive rack 46. Thus, the return pinion 63 can be rotated in a direction of an arrow L.

Through the rotation of the return pinion 63, the ratchet wheel 74 can be rotated in a direction of an arrow M. Thus, the internal teeth 74*a* of the ratchet wheel 74 are meshed with the clutch member 73. Therefore, the sun gear 66 (see FIG. 12) can be rotated in the direction of the arrow M together with the clutch member 73. Through the rotation of the sun gear 66, the planetary gear 67 idles in a free state in a direction of an arrow N.

Based on the operation described above, the movable blade 22 can be moved to the cutting position P1. Thus, the recording sheet P can be cut between the fixed blade 34 and the movable blade 22. At this time, when the paper jam 95 occurs between the movable blade 22 and the fixed blade 34, the movable blade 22 stops at a position at which the movable blade 22 rides on the fixed blade 34.

Figure 14:
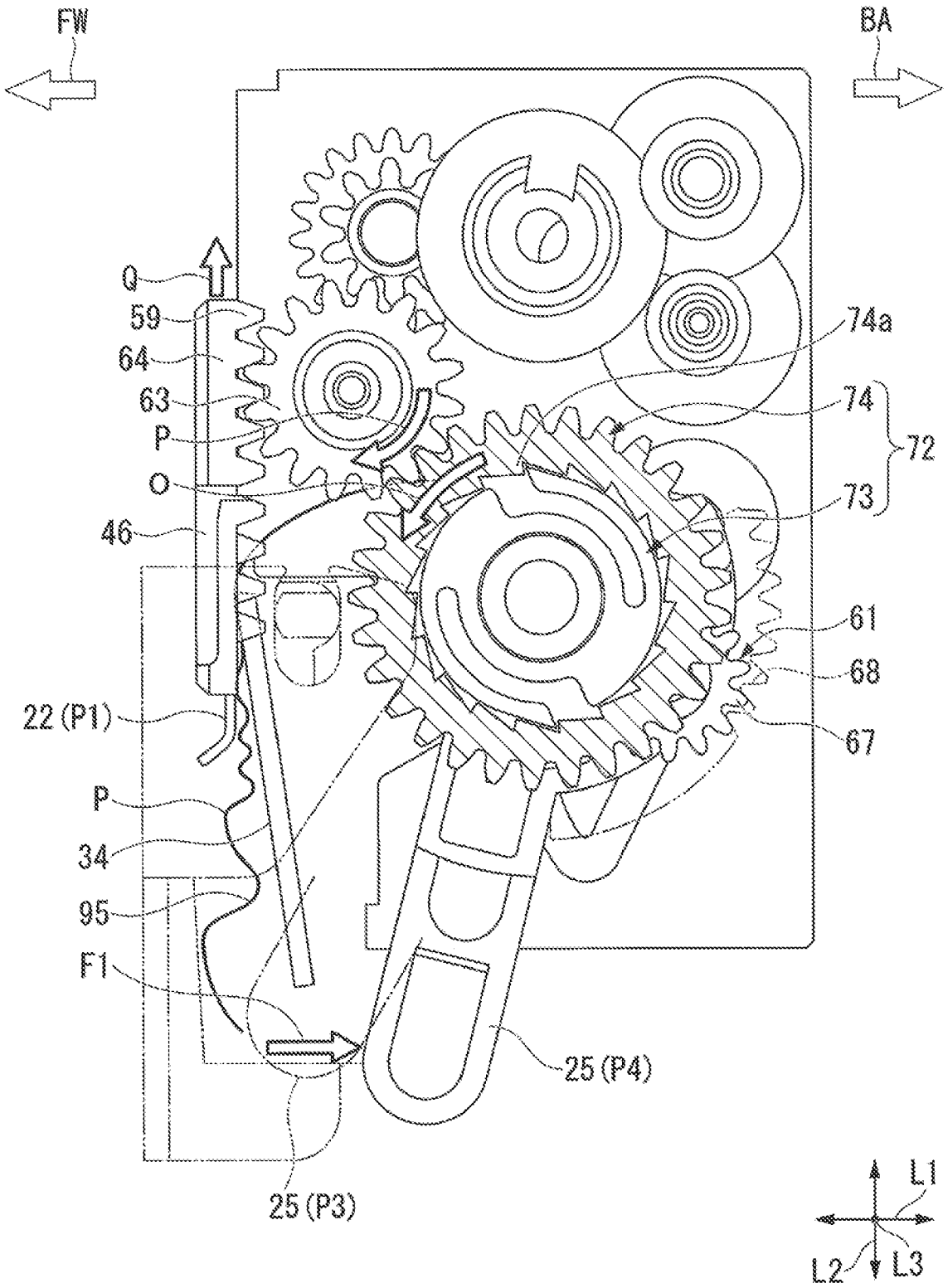
FIG. 14 is a sectional view for illustrating an operation in which the operation lever is operated (first operation) from the state illustrated in FIG. 13.
Figure 15:
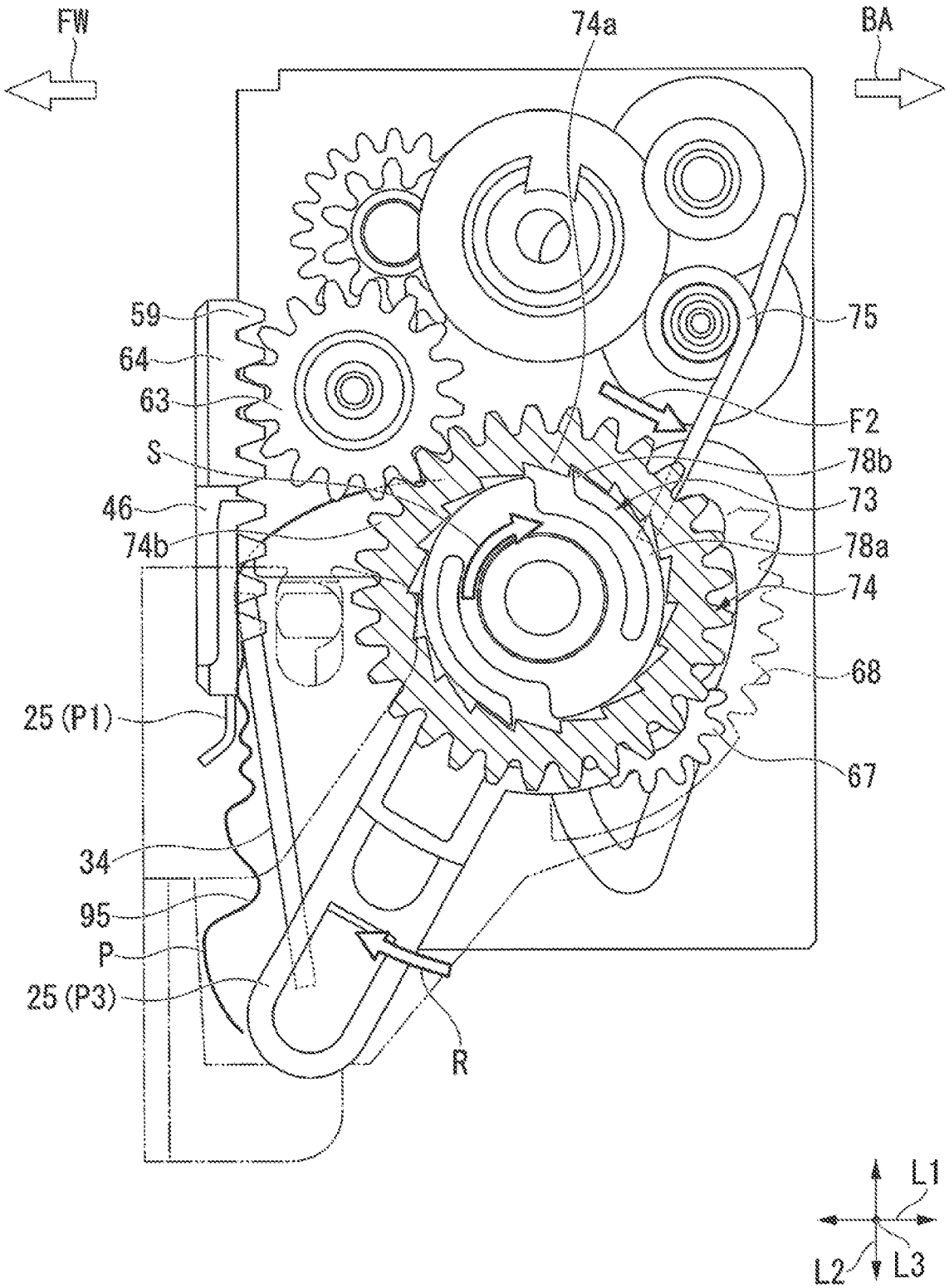
FIG. 15 is a sectional view for illustrating an operation in which the operation lever is returned to the lock position from the state illustrated in FIG. 14.

As illustrated in FIG. 14, the operation lever 25 is operated from the lock position P3 toward the abutment position P4 with the operation force F under a state in which the movable blade 22 is stopped due to the paper jam 95. With the operation described above, the planetary gear 67 is revolved toward the internal gear 68 to be meshed with the internal gear 68. Thus, the planetary gear 67 can be revolved while being rotated. In this manner, the clutch member 73 can be rotated in a direction of an arrow O through intermediation of the sun gear 66. At this time, the clutch member 73 is meshed with the internal teeth 74*a* of the ratchet wheel 74. Thus, the ratchet wheel 74 can be rotated in the direction of the arrow O together with the clutch member 73. Hence, the return pinion 63 meshing with the external teeth 74*b* of the ratchet wheel 74 can be rotated in a direction of an arrow P. Therefore, the drive rack 46 can be moved in a direction of an arrow Q toward the standby position P2 side of the movable blade 22 together with the return rack 64 meshing with the return pinion 63.

In the step described above, the ratchet wheel 74 is individually rotated by the acceleration mechanism 61 with respect to the operation lever 25. Thus, a large rotation amount of the ratchet wheel 74 can be ensured for the operation stroke amount of the operation lever 25. Specifically, a rotation amount of the ratchet wheel 74, which is required to return the movable blade 22 to the standby position P2, can be ensured under a state in which the operation stroke amount of the operation lever 25 is suppressed.

Then, when the operation lever 25 is operated to the abutment position P4, the lever projecting portion 57 is brought into abutment against the cam projecting portion 97. Under this state, however, the paper jam 95 occurring between the movable blade 22 and the fixed blade 34 is not eliminated yet. Thus, the movable blade 22 is in a state of riding on the fixed blade 34. Therefore, the platen unit 4 is prevented by the movable blade 22 from being opened. Therefore, the movement of the lever projecting portion 57 abutting against the cam projecting portion 97 is prevented by the cam projecting portion 97. Thus, a further operation of the operation lever 25 is prevented, and a first operation of the operation lever 25 is completed.

When the operation force F1, which has been exerted on the operation lever 25, is removed under the above-mentioned state, the operation lever 25 can be operated toward the lock position P3 in a direction of an arrow R with use of the elastic restoring force (biasing force F2) of the biasing member 75. When the operation lever 25 is moved toward the lock position P3, the planetary gear 67 is rotated while being meshed with the internal gear 68. Thus, the clutch member 73 can be rotated in a direction of an arrow S through intermediation of the sun gear 66.

At this time, the return pinion 63 is meshed with the external teeth 74*b* of the ratchet wheel 74, and the rack teeth 59 of the return rack 64 are meshed with the return pinion 63. However, the movable blade 22 is stopped in the middle of a way to the standby position P2 due to the paper jam 95. Thus, the return pinion 63 and the ratchet wheel 74 are kept in the stationary state.

Therefore, the clutch member 73 is likely to be rotated in the direction of the arrow S with respect to the ratchet wheel 74 in the stationary state. Thus, the meshing claws 78*b* climb over the internal teeth 74*a* while the arm portions 78*a* are elastically deformed, and the meshing between the internal teeth 74*a* and the meshing claws 78*b* is released. Thus, the clutch member 73 idles to rotate in the direction of the arrow S. Therefore, the operation lever 25 can be returned to the lock position P3 with use of the elastic restoring force (biasing force F2) of the biasing member 75.

Figure 16:
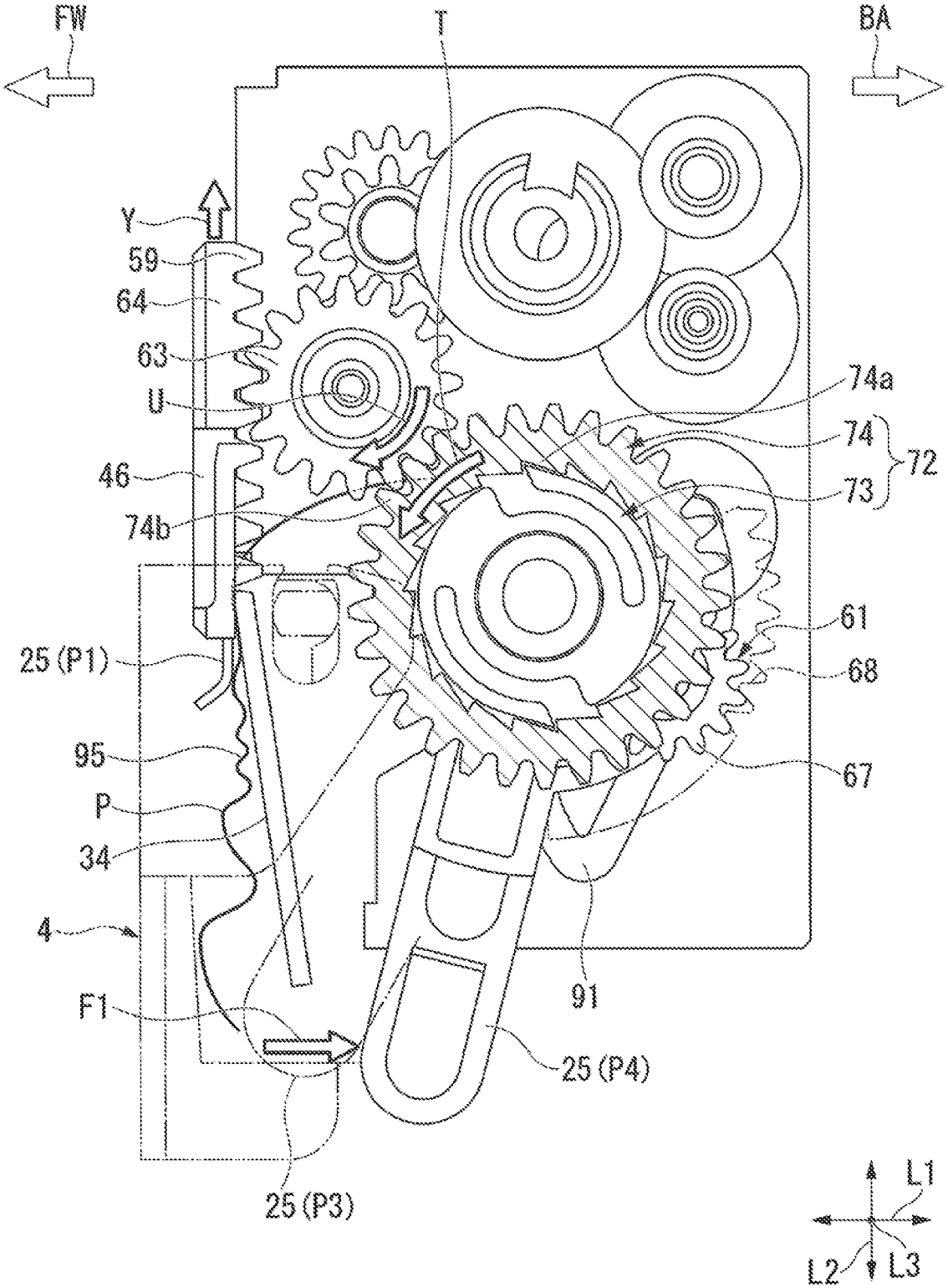
FIG. 16 is a sectional view for illustrating an operation in which the operation lever is operated again (second operation) from the state illustrated in FIG. 15.

Therefore, a second operation can be performed so that the operation lever 25 is moved from the lock position P3 toward the side of the abutment position P4 and the releasing position P5 as illustrated in FIG. 16. As illustrated in FIG. 16, the operation lever 25, which has been returned to the lock position P3, is operated again with the operation force F1. As a result, as in the case described above, after the planetary gear 67 is revolved toward the internal gear 68 to be meshed with the internal gear 68, the planetary gear 67 revolves while rotating. Thus, the sun gear 66, the clutch member 73, and the ratchet wheel 74 can be rotated in a direction of an arrow T. Therefore, the return pinion 63 meshed with the external teeth 74*b* of the ratchet wheel 74 can be rotated in a direction of an arrow U, and the drive rack 46 can be moved in a direction of an arrow Y together with the return rack 64.

As a result, the movable blade 22 can be further moved from the state illustrated in FIG. 16 to the standby position P2. Thus, a state in which the movable blade 22 overlaps with the fixed blade 34 can be cancelled.

Then, when the operation lever 25 is operated from the lock position P3 to the abutment position P4, the lever projecting portion 57 is brought into abutment against the cam projecting portion 97 as described above. At this time, the movable blade 22 has been moved to the standby position P2 as described above. Thus, the operation lever 25 can be operated to the releasing position P5 beyond the abutment position P4 illustrated in FIG. 16. Accordingly, the cam projecting portion 97 can be pushed up with use of the lever projecting portion 57, and the bearing 96 can be lifted up with use of the release cam 91.

As a result, the platen unit 4 can be unlocked to eliminate the paper jam 95 occurring between the movable blade 22 and the fixed blade 34.

As described above, by repeating the operation of the operation lever 25 twice, the movable blade 22 can be reliably returned to the standby position P2. In this manner, the paper jam 95 occurring between the fixed blade 34 and the movable blade 22 can easily be eliminated. Further, by repeating the operation of the operation lever 25 twice, the operation stroke amount of the operation lever 25 at the time of operation of the operation lever 25 from the lock position P3 can be suppressed.

Certain embodiments of the present invention have been described. However, those embodiments are presented as examples and are not intended to limit the scope of the invention. Those embodiments may be implemented in other various modes, and various kinds of omissions, replacements, and modifications can be made without departing from the gist of the invention. The embodiment and modification examples thereof encompass, for example, those easily conceived by those skilled in the art, substantially identical ones, and those falling within an equivalent range.

For example, in the above-mentioned embodiment, description is given of the example in which the fixed blade 34 is provided on the printer cover 3 (specifically, the platen unit 4), and the movable blade 22 is provided on the casing 2 (specifically, the head unit 5), but the present invention is not limited to this case. For example, the fixed blade 34 may be provided on the casing 2 side, and the movable blade 22 may be provided on the printer cover 3 side.

Further, in the above-mentioned embodiment, description is given of the example in which the fixed blade 34 is kept in a fixed state, and the movable blade 22 is returned to the standby position P2 by the unlocking lever 25, to thereby eliminate the paper jam 95, but the present invention is not limited to this case. For example, the fixed blade 34 may be configured as follows. When the movable blade 22 is returned to the standby position P2 with use of the operation lever 25, the fixed blade 34 may be separated from the movable blade 22. In this case, for example, even an operation of separating the fixed blade 34 from the movable blade 22 may be performed with use of the operation lever 25.

Further, in the above-mentioned embodiment, description is given of the example in which the operation lever 25 is operated in association with the pivoting operation of the operation lever 13, but the present invention is not limited to this case. For example, the distal end portion 25*c* of the operation lever 25 may be exposed to the outside of the casing 2 so that a user can directly operate the operation lever 25 from the outside of the casing 2.

Further, in the above-mentioned embodiment, description is given of the example in which the return rack 64 is formed integrally with the drive rack 46, but the present invention is not limited to this case. For example, the return rack 64 may be provided separately from the drive rack 46. In this case, the return rack 64 is only required to be mounted to the movable blade 22.

Further, in the above-mentioned embodiment, description is given of the example in which the return rack 64 is arranged on the outer side of the drive rack 46, but the present invention is not limited to this case. For example, the return rack 64 may be arranged on an inner side of the drive rack 46.

Further, in the above-mentioned embodiment, description is given of the example in which the acceleration mechanism includes the sun gear 66, the planetary gear 67, and the internal gear 68. However, for example, the acceleration mechanism 61 may have another configuration.

Further, in the above-mentioned embodiment, description is given of the example in which the clutch member 73 of the ratchet mechanism 72 has the pair of clutch tooth portions 78 (specifically, the meshing claws 78*b*). However, the number of claws of the meshing claws 78*b* may be suitably selected, and a shape of each of the meshing claws 78*b* may also be suitably selected. Further, for example, the number of the internal teeth 74*a* of the ratchet wheel 74 and a shape of each of the internal teeth 74*a* may be suitably selected. Specifically, the number of the meshing claws 78*b* and a shape of each of the meshing claws 78*b*, and the number of the internal teeth 74*a* and a shape of each of the internal teeth 74*a* are only required to be set so that the ratchet mechanism 72 can transmit the rotating operation only in a suitable direction.

Further, in the above-mentioned embodiment, description is given of the example in which the clutch member 73 is arranged on the inner side of the ratchet wheel 74. However, the clutch member 73 may also be arranged on an outer side of the ratchet wheel 74. Further, there has been described the example in which the internal teeth 74*a* are formed on the inner peripheral surface of the ratchet wheel 74 and the clutch member 73 has the meshing claws 78*b*, but the configuration of the clutch member 73 and the ratchet wheel 74 are not limited to this case. For example, the ratchet wheel 74 may have claw portions, and tooth portions may be formed on the clutch member 73.

Further, in the above-mentioned embodiment, description is given of the example in which the ratchet mechanism 72 includes the clutch member 73 and the ratchet wheel 74. However, the configuration of the ratchet mechanism 72 is not limited to this case. For example, the ratchet mechanism may have another configuration.

Further, in the above-mentioned embodiment, description is given of the example in which the operation of the operation lever 25 is repeated twice as a preferred number of repetitions of the operations. However, the number of repetitions of the operation as the operation of the operation lever 25 is not limited to this case. For example, the operation of the operation lever 25 may be repeated three times or more.

Further, in the above-mentioned embodiment, a correction member may be further provided. The correction member is configured to correct a posture of the planetary gear 67 with respect to the internal gear 68 to set a phase of the planetary gear 67 in a suitable state at the time of meshing with the internal gear 68 so that the internal gear 68 and the planetary gear 67 are always meshed with each other in a predetermined meshing relationship. This case is described in detail below.

Figure 17:
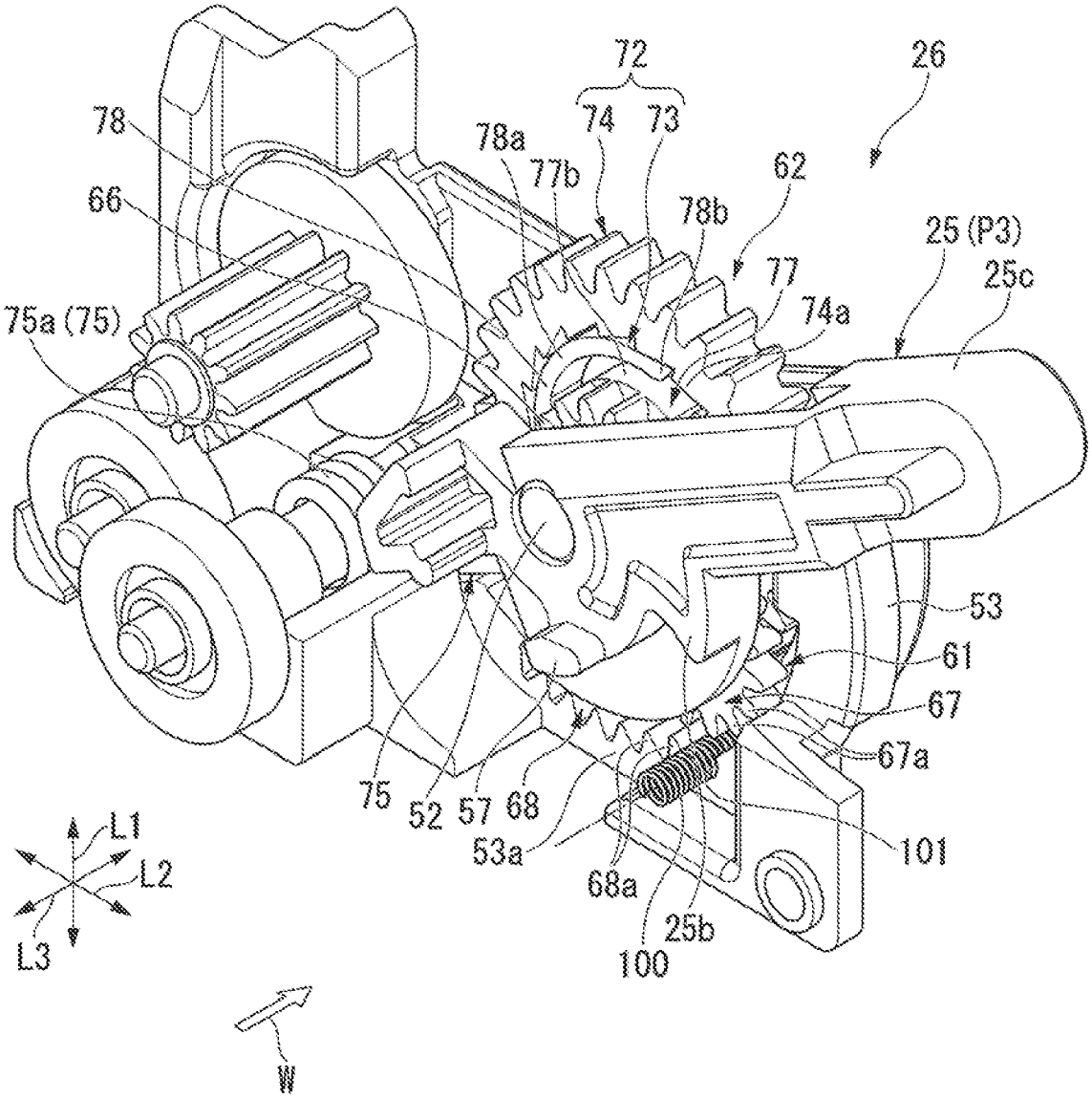
FIG. 17 is a perspective view for illustrating a modification example of the embodiment of the present invention, which is an illustration of a return mechanism and an operation lever.
Figure 18:
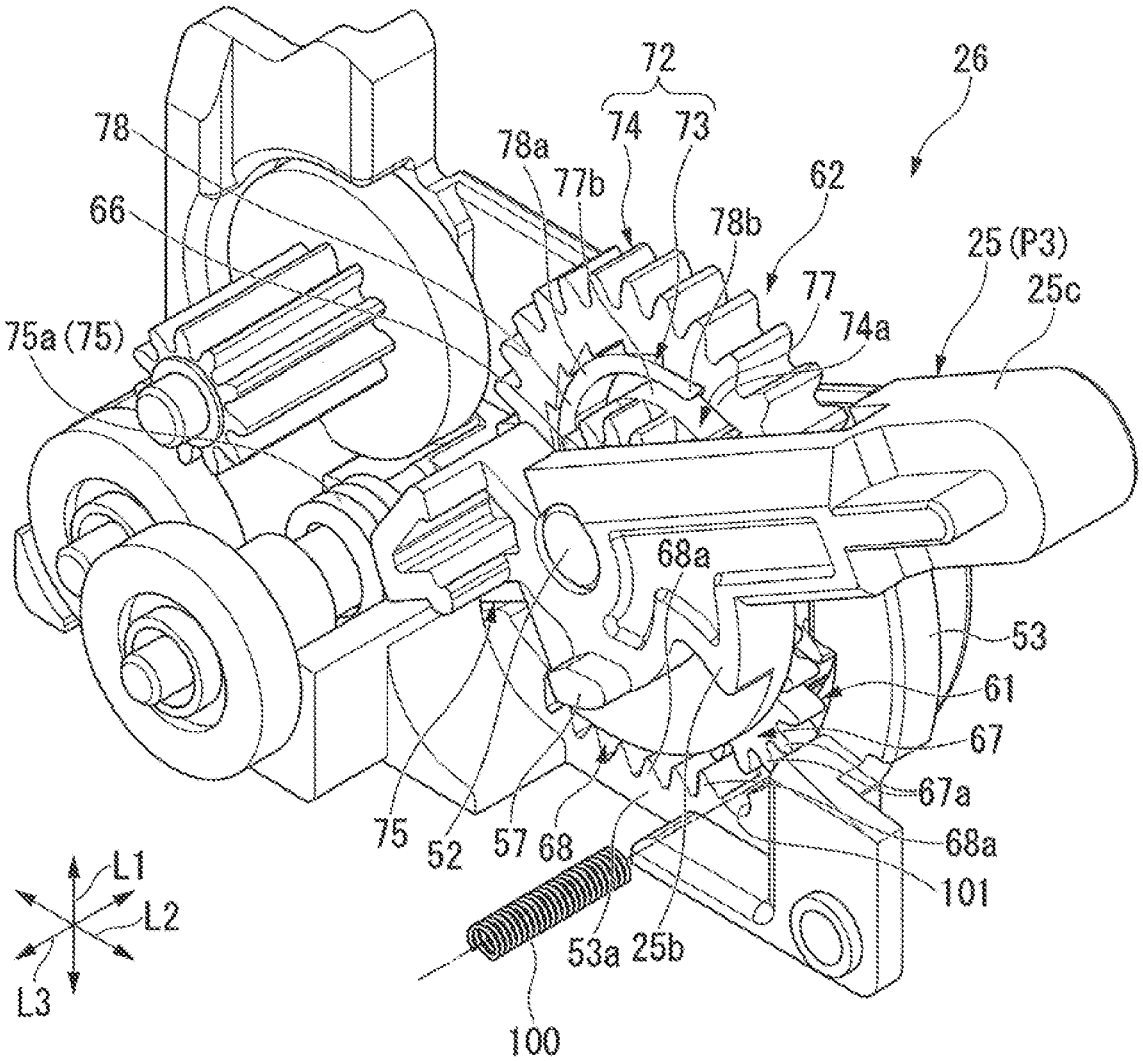
FIG. 18 is an illustration of a state in which a coil spring is removed from the state illustrated in FIG. 17.
Figure 19:
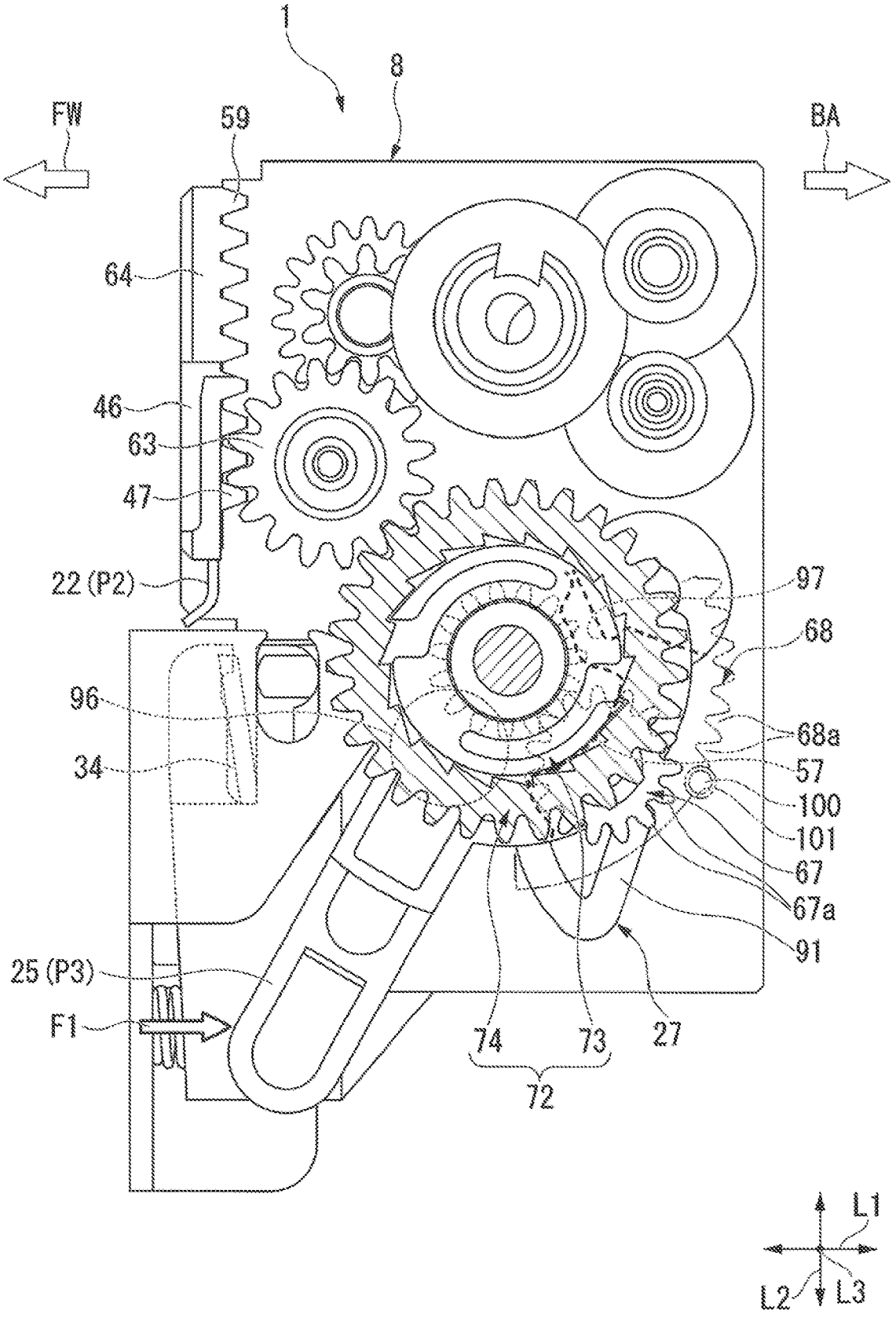
FIG. 19 is a sectional view of the printing unit under a state in which the movable blade is located at the standby position and the operation lever is located at the lock position.

As illustrated in FIG. 17 to FIG. 19, in the printing unit 8 of this case, the return mechanism 26 includes a coil spring (elastic member; specifically, correction member according to the present invention) 100. When the planetary gear 67 is revolved along with the operation (operation from the lock position P3 toward the side of the abutment position P4 and the releasing position P5) of the operation lever 25, the coil spring 100 corrects a posture of the planetary gear 67 with respect to the internal gear 68 so that the planetary gear 67 is meshed with the internal gear 68 in a predetermined meshing relationship.

More specifically, the coil spring 100 is disposed so as to be closer to the lock position P3 side of the operation lever 25 than the internal gear 68. The planetary tooth portions 67*a* of the planetary gear 67 can be brought into sliding contact with the coil spring 100. The coil spring 100 is arranged approximately in parallel to the lever support shaft 52, and is fixed inside a mounting hole 101 formed in the cover curved portion 53*a* of the exterior cover 53. The mounting hole 101 is located so as to be closer to the lock position P3 side of the operation lever 25 than a first tooth of internal tooth portions 68*a* of the internal gear 68, with which the planetary gear 67 is first meshed. The mounting hole 101 is formed on the inner peripheral portion 53*b* of the cover curved portion 53*a* so as to be recessed in a semi-circular shape. In the illustrated example, the mounting hole 101 is formed so as to be adjacent to the first tooth of the internal tooth portions 68*a*, and is formed so as to extend approximately in parallel to the lever support shaft 52.

The coil spring 100 is mounted inside the mounting hole 101 in such a manner as to be inserted therein from an inner side, and is firmly fixed with use of, for example, an adhesive. In the illustrated example, the coil spring 100 has such a length as to project toward the inner side with respect to the cover curved portion 53*a*. However, the length of the coil spring 100 is not limited to this case, and may be suitably changed.

As described above, the coil spring 100 is disposed in approximately parallel to the lever support shaft 52 with use of the mounting hole 101. Therefore, the coil spring 100 is elastically deformable in a radial direction of the planetary gear 67. Further, when the planetary gear 67 is revolved along with the operation of the operation lever 25, the planetary tooth portions 67*a* can be brought into sliding contact with the coil spring 100 in such a manner as to slide on an outer peripheral surface of the coil spring 100 while elastically deforming the coil spring 100 in the radial direction. In addition, the coil spring 100 can shift a phase of the planetary gear 67 by applying an elastic restoring force through intermediation of the planetary tooth portions 67*a* along with the elastic restoring deformation so as to press the planetary gear 67 in the radial direction or a circumferential direction by, for example, a mounting error for the planetary gear 67.

Thus, the coil spring 100 can correct the posture of the planetary gear 67 so that the planetary tooth portions 67*a* of the planetary gear 67 and the first tooth of the internal tooth portions 68*a* have such a meshing relationship that tooth tips thereof do not come into contact with each other.

An action of the return mechanism 26 including the coil spring 100 having the configuration described above is now described with reference to FIG. 20 to FIG. 23. FIG. 20 to FIG. 23 are enlarged side views of the coil spring 100 and a periphery thereof when viewed in a direction of an arrow W illustrated in FIG. 17.

Figure 20:
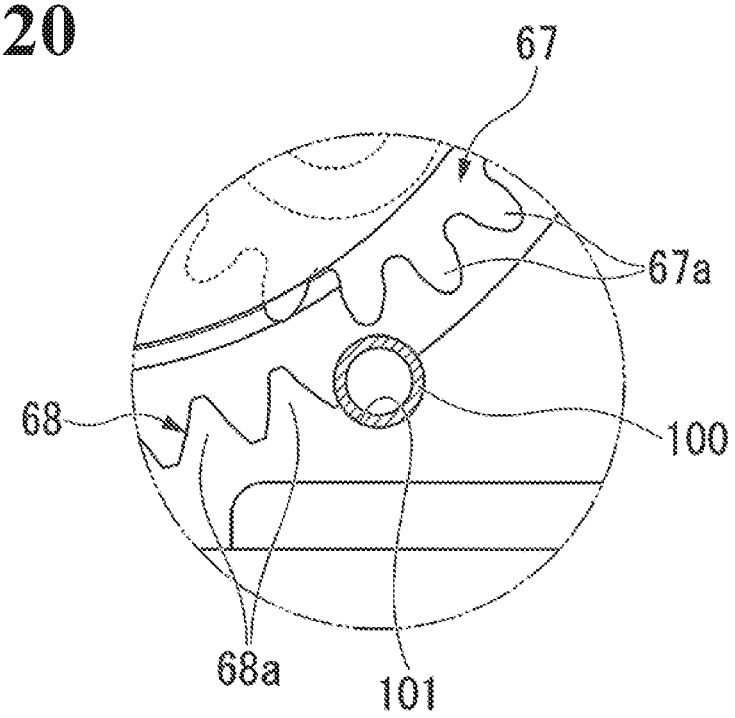
FIG. 20 is an enlarged side view of a coil spring and a periphery thereof when viewed in a direction of an arrow W illustrated in FIG. 17.

As described above, when the operation lever 25 is located at the lock position P3, the meshing between the planetary gear 67 and the internal gear 68 is avoided as illustrated in FIG. 17, FIG. 19, and FIG. 20. Thus, the idling of the planetary gear 67 is permitted. Therefore, in this stage, a rotating posture of the planetary gear 67 is not maintained in a fixed state. Therefore, when the planetary gear 67 is revolved along with a subsequent operation of the operation lever 25, the rotating posture of the planetary gear 67 toward the internal gear 68 is changed.

Accordingly, for example, depending on the rotating posture of the planetary gear 67, the planetary gear 67 may possibly be revolved so that, for example, the tooth tip of a corresponding one of the internal tooth portions 68*a* and the tooth tip of the planetary tooth portion 67*a* come into contact with each other and the internal tooth portions 68*a* and the planetary tooth portions 67*a* abut against each other.

According to this embodiment, however, the coil spring 100 is provided so as to be closer to the lock position P3 side of the operation lever 25 than the first tooth of the internal tooth portions 68*a* of the internal gear 68. Thus, when the operation lever 25 is operated from the lock portion P3 toward the side of the abutment position P4 and the releasing position P5 to revolve the planetary gear 67, the posture of the planetary gear 67 with respect to the internal gear 68 can be corrected by the coil spring 100.

Figure 21:
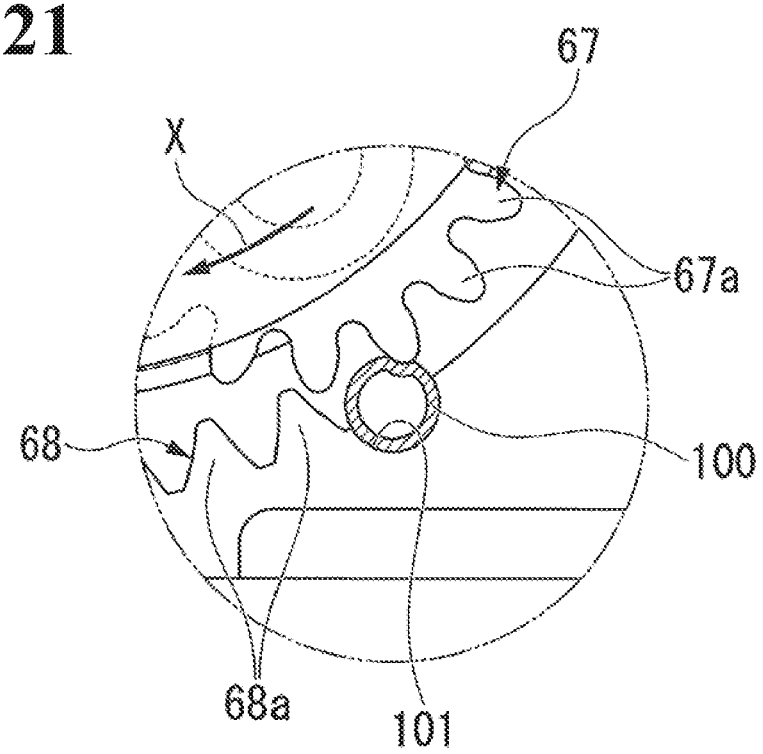
FIG. 21 is a side view for illustrating a state in which a planetary gear is revolved from the state illustrated in FIG. 20 toward an internal gear.

More specifically, as illustrated in FIG. 21, when the planetary gear 67 is revolved in a direction of an arrow X, the planetary tooth portions 67*a* can be brought into sliding contact with the coil spring 100 before a corresponding one of the planetary tooth portions 67*a* is meshed with the first tooth of the internal tooth portions 68*a*. As a result, the planetary tooth portions 67*a* can be slid on the outer peripheral surface of the coil spring 100. In addition, when the planetary tooth portions 67*a* are brought into sliding contact with the coil spring 100, the coil spring 100 can be elastically deformed. Then, the planetary gear 67 is continuously revolved in such a way as to slide on the outer peripheral surface of the coil spring 100 in the direction of the arrow X along with a further operation of the operation lever 25 while elastically deforming the coil spring 100. During the operation described above, an elastic restoring force of the coil spring 100 can be exerted on the entire planetary gear 67.

Figure 22:
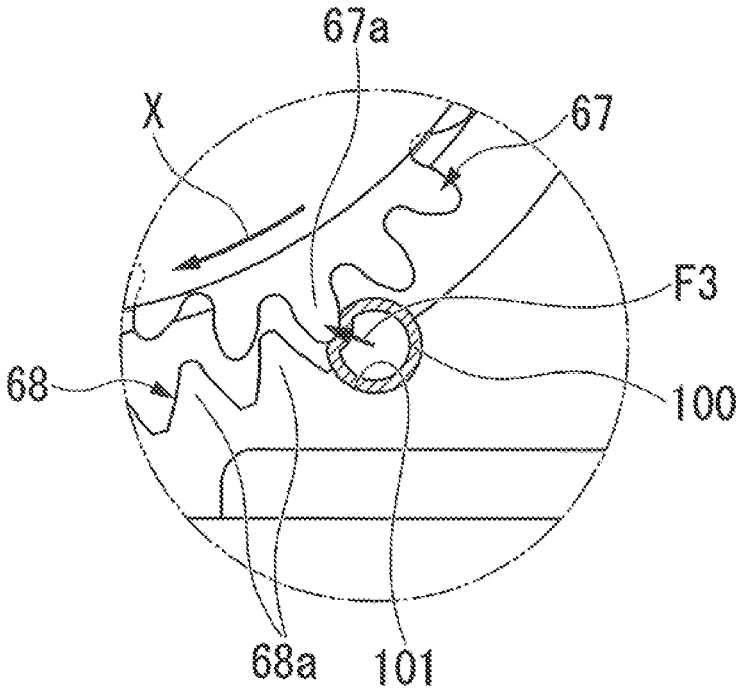
FIG. 22 is a side view for illustrating a state in which the planetary gear is further revolved from the state illustrated in FIG. 21.

In particular, as illustrated in FIG. 22, when a corresponding one of the planetary tooth portions 67*a*, which is in contact with the coil spring 100, is moved so as to climb over the coil spring 100 through further revolution of the planetary gear 67, the planetary gear 67 not only slides on the outer peripheral surface of the coil sprig 100 but also is subjected to the elastic restoring force of the coil spring 100, which is indicated by an arrow F3. As a result, the planetary gear 67 is forced toward the first tooth of the internal tooth portions 68*a* by the mounting error for the planetary gear 67 to change a contact angle with respect to the internal tooth portions 68*a*.

Figure 23:
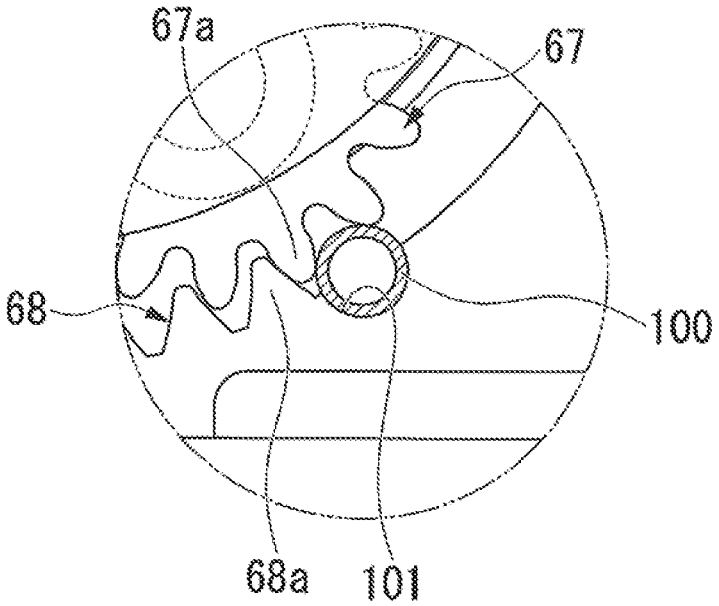
FIG. 23 is a side view for illustrating a state in which the planetary gear is further revolved from the state illustrated in FIG. 22 to mesh a corresponding one of planetary tooth portions with a first tooth of internal tooth portions of the internal gear.

As a result, the phase of the planetary gear 67 can be forced to be shifted, and the planetary gear 67 can always be meshed with the internal gear 68 in a predetermined meshing relationship, as illustrated in FIG. 23. Specifically, the phase of the planetary gear 67 at the time of meshing with the internal gear 68 can be maintained in an appropriate state, and the planetary gear 67 can be suitably meshed with the first tooth of the internal tooth portions 68*a* of the internal gear 68 at every time of operation.

More specifically, the planetary gear 67 can be meshed with the internal gear 68 so as to achieve such a meshing relationship that the tooth tip of the first tooth of the internal tooth portions 68*a* and a corresponding one of the tooth tips of the planetary tooth portions 67*a* do not come into contact with each other. Therefore, the planetary gear 67 and the internal gear 68 can be appropriately meshed with each other so that tooth faces of the internal tooth portions 68*a* and tooth faces of the planetary tooth portions 67*a* come into contact with each other. Thus, there can be prevented inconvenience that, for example, the tooth tips of the internal tooth portions 68*a* and the tooth tips of the planetary tooth portions 67*a* may abut against each other.

Therefore, the phase of the planetary gear 67 at the time of meshing with the internal gear 68 can be more reliably maintained in an appropriate state, and the planetary gear 67 can be appropriately meshed with the internal gear 68 at every time of operation. Thus, as described above, not only occurrence of a problem that the tooth tips of the internal gear 68 and the tooth tips of the planetary gear 67 abut against each other (interference between the internal gear 68 and the planetary gear 67) is prevented, but also a fault and a rotation failure of the planetary gear 67 due to abutment, and a fault and an operation failure in the vicinity of the planetary gear 67 can be prevented. As a result, operation performance of the operation lever 25 can be improved to enable a more stable lever operation. In addition, a simple configuration with use of only the coil spring 100 is required, which can lead to simplification of the configuration and cost reduction.

When the planetary tooth portions 67*a* is brought into sliding contact with the outer peripheral surface of the coil spring 100, the planetary tooth portions 67*a* and the outer peripheral surface of the coil spring 100 are held in sliding contact with each other in a linear contact state depending on a shape of the coil spring 100. Therefore, a friction resistance between the planetary tooth portions 67*a* and the coil spring 100 can be suppressed. Thus, the actions and effects described above can be further effectively achieved.

In the above-mentioned embodiment, the coil spring 100 has been described as an example of the elastic member, which is the correction member. However, the elastic member is not limited to the coil spring. Any member having elasticity and a characteristic excellent in lubricity can be used as the elastic member, and actions and effects equivalent to those obtained with use of the coil spring 100 can be achieved. For example, an elastic member using a rubber or urethan (urethan rubber or urethan resin), a wire spring, or a torsion spring can also be used as the elastic member.

Figure 24:
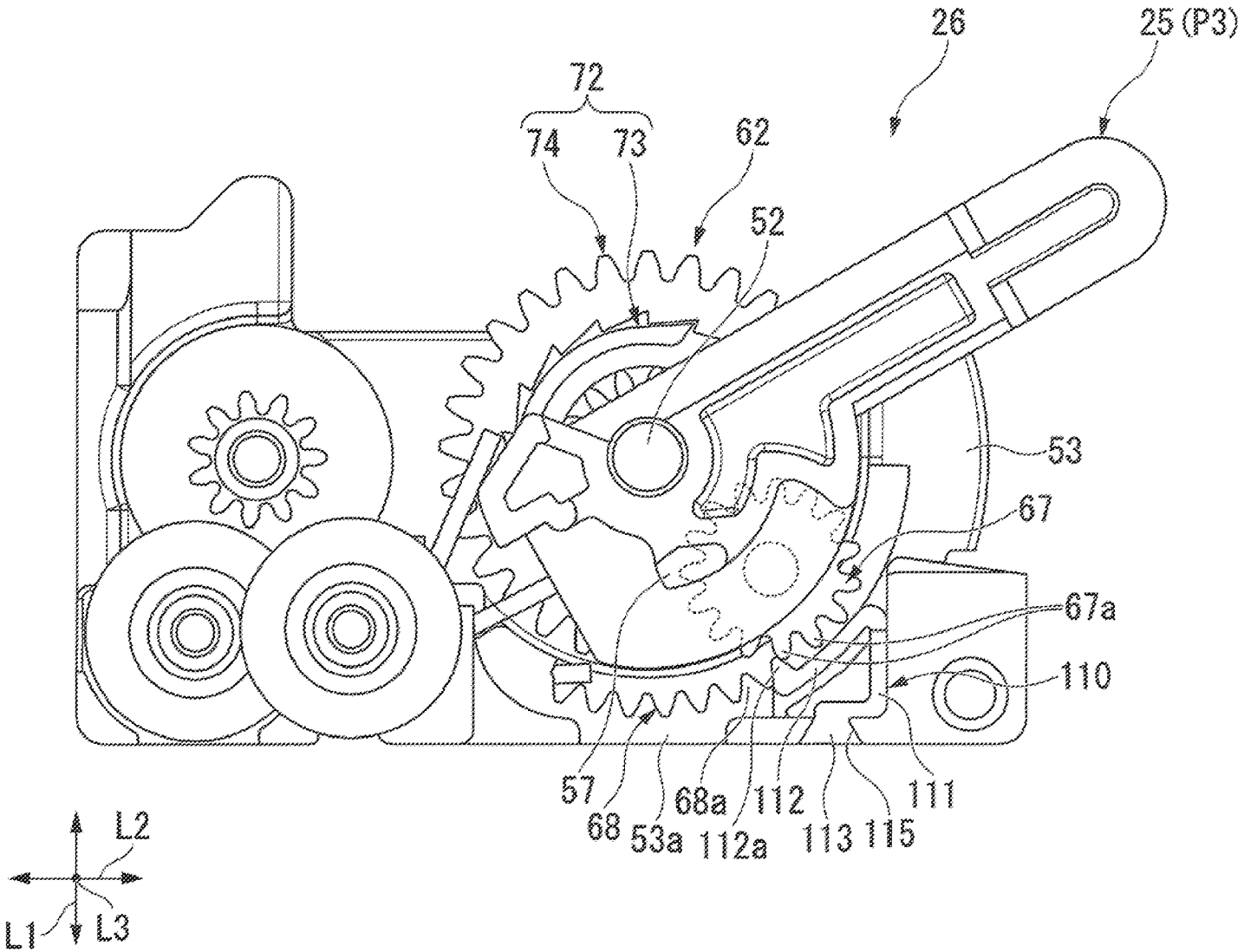
FIG. 24 is a side view for illustrating a modification example of the embodiment of the present invention, which is an illustration of a return mechanism and an operation lever.
Figure 25:
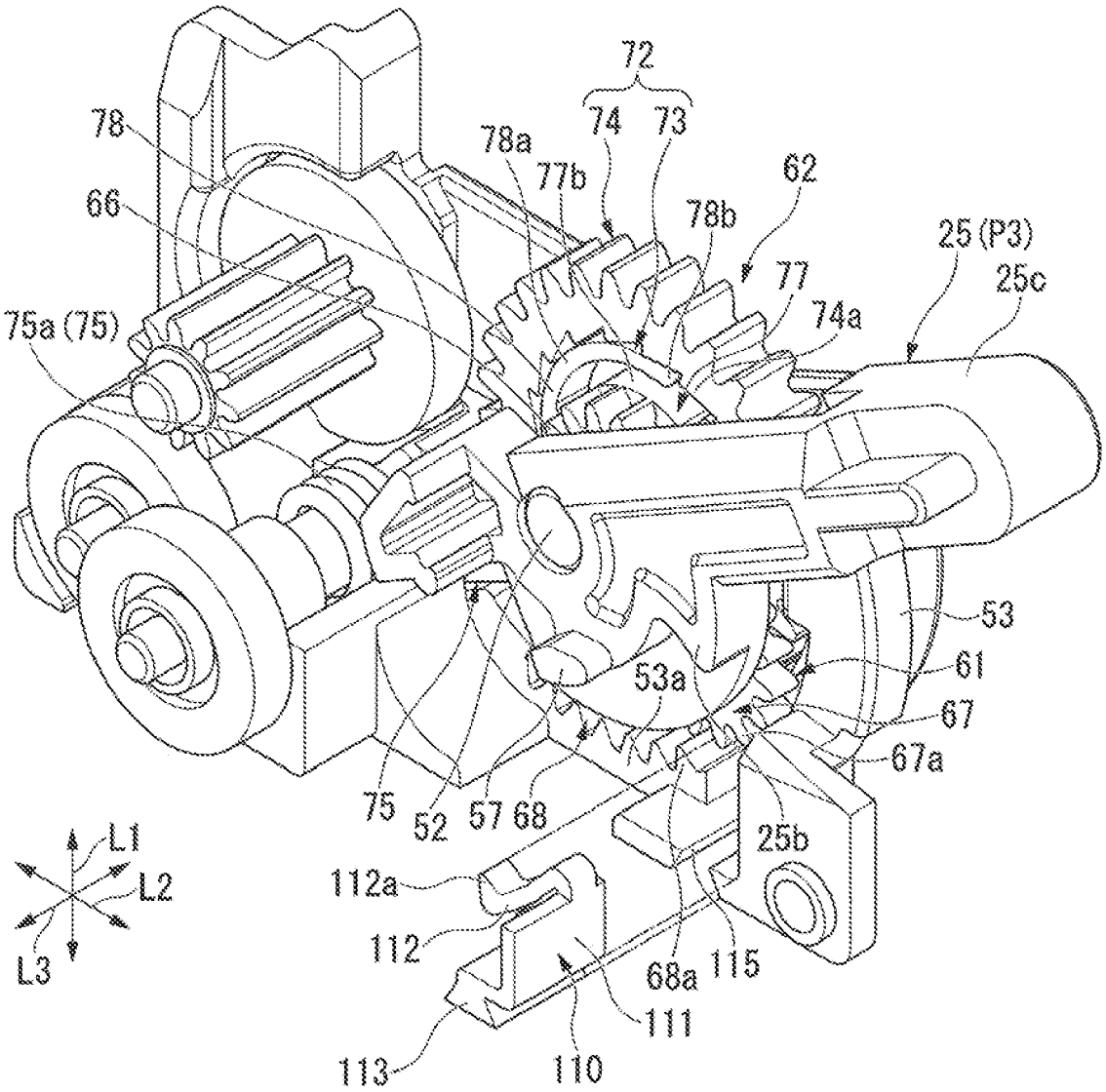
FIG. 25 is a perspective view for illustrating a state in which an elastic body is removed from the state illustrated in FIG. 24.

Further, as illustrated in FIG. 24 and FIG. 25, an elastic member 110, which is integrally formed of a synthetic resin material, may be used. The elastic member 110 in this case includes an arm support portion 111 and an arm piece 112. The arm support portion 111 is removably mounted to the exterior cover 53. The arm piece 112 is supported in a cantilever manner with respect to the arm support portion 111, and is elastically deformable in the radial direction of the planetary gear 67.

The arm support portion 111 has a fitting projection 113 to be fitted into a mounting hole 115 formed in the exterior cover 53. With the fitting of the fitting projection 113 into the mounting hole 115, the arm support portion 111 is mounted integrally to the exterior cover 53 in a retained state. The arm piece 112 has a proximal end portion coupled to the arm support portion 111. At a distal end portion of the arm piece 112, a claw portion 112*a* projecting toward the planetary gear 67 side is formed. The claw portion 112*a* is arranged so as to be adjacent to the first tooth of the internal tooth portions 68*a*.

Even in a case in which the elastic member 110 having the configuration described above is used, when the planetary gear 67 is revolved along with the operation of the operation lever 25, the planetary tooth portions 67*a* can be brought into sliding contact with the claw portion 112*a* in such a manner as to slide on the claw portion 112*a* while elastically deforming the arm piece 112. Therefore, the actions and effects equivalent to those obtained in a case in which the coil spring 100 described above is used can be achieved.

What is claimed is:

1. A printing unit, comprising:

a head unit including a thermal head configured to perform printing on a recording sheet;

a platen unit, which includes a platen roller configured to convey the recording sheet, and is separately combined with the head unit;

a fixed blade provided to any one of the head unit and the platen unit;

a movable blade, which is provided to another one of the head unit and the platen unit, and is relatively movable with respect to the fixed blade;

a drive mechanism, which includes a drive rack coupled to the movable blade, and is configured to move the movable blade between a standby position being separated from the fixed blade and a cutting position at which the movable blade rides on the fixed blade;

an operation lever being movable between a lock position at which the platen unit is locked to the head unit and a releasing position at which the platen unit is unlocked from the head unit; and a return mechanism configured to move the movable blade from the cutting position toward the standby position side through intermediation of the drive rack in association with the operation lever under a state in which the movable blade is stopped at the cutting position, wherein the return mechanism includes a lever returning mechanism configured to, under the state in which movable blade is stopped at the cutting position, transmit motive power generated along with an operation of the operation lever from the lock position toward the releasing position to the drive mechanism to move the movable blade toward the standby position and to return the operated operation lever from the releasing position side to the lock position, wherein the lever returning mechanism includes:

a clutch member, which is configured to rotate along with movement of the operation lever, and has a first engagement portion;

a ratchet wheel, which is formed so as to surround the clutch member, and has a second engagement portion to be engaged with the first engagement portion when the clutch member is rotated in one direction, the ratchet wheel being capable of performing transmission of the motive power from and to the drive mechanism;

a biasing member configured to bias the operation lever from the releasing position side toward the lock position, wherein, when the operation lever is operated from the lock position toward the releasing position side under the state in which the movable blade is stopped at the cutting position, the clutch member and the ratchet wheel are both rotated through engagement between the first engagement portion and the second engagement portion so as to transmit the motive power from the ratchet wheel to the drive mechanism, and wherein, when the operation lever is moved from the releasing position side toward the lock position by the biasing member under the state in which the movable blade is stopped at the cutting position, the first engagement portion and the second engagement portion are placed in a non-engaged state to allow the clutch member to idle with respect to the ratchet wheel.

2. The printing unit according to claim 1, wherein the return mechanism includes:

a return rack formed on the drive rack; and a return pinion to be meshed with rack teeth of the return rack, and wherein the ratchet wheel has external teeth to be meshed with the return pinion.

3. The printing unit according to claim 2, wherein the return mechanism includes:

a sun gear, which is rotatably supported about a rotation axis of the operation lever, and is coupled to the clutch member in a state of being arranged coaxially with the rotation axis of the operation lever;

a planetary gear, which is to be meshed with the sun gear, and is revolved along with movement of the operation lever; and an internal gear to be meshed with the planetary gear when the planetary gear is revolved, and wherein, when the operation lever is located at the lock position, the meshing of the planetary gear with the internal gear is released to permit the planetary gear to idle.

4. The printing unit according to claim 2, wherein the rack teeth are formed on a side opposite to a blade edge of the movable blade so that the rack teeth are meshed with the return pinion when the movable blade is located at the cutting position and the meshing with the return pinion is released when the movable blade is located at the standby state.

5. The printing unit according to claim 3, wherein the return mechanism includes a correction member configured to correct a posture of the planetary gear with respect to the internal gear so that the planetary gear is meshed with the internal gear in a predetermined meshing relationship when the planetary gear is revolved.

6. The printing unit according to claim 5, wherein the correction member is configured to correct the posture of the planetary gear to achieve such a meshing relationship that a tooth tip of a corresponding one of planetary tooth portions of the planetary gear and a tooth tip of a first tooth of internal tooth portions of the internal gear, with which the planetary gear is to be first meshed, are prevented from coming into contact with each other.

7. The printing unit according to claim 6, wherein the correction member comprises an elastic member, which is disposed so as to be closer to the lock position of the operation lever than the internal gear, and with which the planetary tooth portions are to be brought into sliding contact, and wherein the elastic member is elastically deformed when the planetary tooth portions are brought into sliding contact with the elastic member, and shifts a phase of the planetary gear along with elastic restoring deformation.

8. The printing unit according to claim 7, wherein the rack teeth are formed on a side opposite to a blade edge of the movable blade so that the rack teeth are meshed with the return pinion when the movable blade is located at the cutting position and the meshing with the return pinion is released when the movable blade is located at the standby state.

9. The printing unit according to claim 8, wherein, when the movable blade is stopped at the cutting position, an operation stroke amount of the operation lever from the lock position toward the releasing position is set so that the movable blade is returned from the cutting position to the standby position through multiple times of operations of the operation lever.

10. The printing unit according to claim 9, wherein the operation stroke amount is set so that the movable blade is returned from the cutting position to the standby position through repetition of the operation of the operation lever twice.

11. A thermal printer, comprising:

the printing unit of claim 10;

a printer main body, which includes a recording-sheet receiving portion configured to receive the recording sheet, and to which one of the head unit and the platen unit, the one being provided with the movable blade, is mounted; and a printer cover, to which another one of the head unit and the platen unit, the another one being provided with the fixed blade, is mounted, and is pivotably coupled to the printer main body.

12. The printing unit according to claim 1, wherein, when the movable blade is stopped at the cutting position, an operation stroke amount of the operation lever from the lock position toward the releasing position is set so that the movable blade is returned from the cutting position to the standby position through multiple times of operations of the operation lever.

13. The printing unit according to claim 12, wherein the operation stroke amount is set so that the movable blade is returned from the cutting position to the standby position through repetition of the operation of the operation lever twice.

14. A thermal printer, comprising:

the printing unit of claim 1;

a printer main body, which includes a recording-sheet receiving portion configured to receive the recording sheet, and to which one of the head unit and the platen unit, the one being provided with the movable blade, is mounted; and a printer cover, to which another one of the head unit and the platen unit, the another one being provided with the fixed blade, is mounted, and is pivotably coupled to the printer main body.

* * * * *